US009265285B2

(12) United States Patent
Gwak et al.

(10) Patent No.: US 9,265,285 B2
(45) Date of Patent: Feb. 23, 2016

(54) LOW IGNITION PROPENSITY CIGARETTE PAPER AND CIGARETTE USING THE SAME

(71) Applicant: KT & G CORPORATION, Daejeon (KR)

(72) Inventors: Ik won Gwak, Daejeon (KR); Jong-Oh Kim, Daejeon (KR); Seong-Ho Ju, Daejeon (KR); Young-Sin Kim, Daejeon (KR); Kwang Se Lee, Daejeon (KR)

(73) Assignee: KT & G CORPORATION, Daejeon (KR)

( * ) Notice: Subject to any disclaimer, the term of this patent is extended or adjusted under 35 U.S.C. 154(b) by 0 days.

(21) Appl. No.: 14/417,127

(22) PCT Filed: Dec. 5, 2012

(86) PCT No.: PCT/KR2012/010477
§ 371 (c)(1),
(2) Date: Jan. 23, 2015

(87) PCT Pub. No.: WO2014/017709
PCT Pub. Date: Jan. 30, 2014

(65) Prior Publication Data

US 2015/0173415 A1 Jun. 25, 2015

(30) Foreign Application Priority Data

Jul. 26, 2012 (KR) ..... 10-2012-0081685

(51) Int. Cl.

| | |
|---|---|
| ***A24D 3/14*** | (2006.01) |
| ***A24D 1/02*** | (2006.01) |
| ***A24D 1/00*** | (2006.01) |
| ***A24D 3/00*** | (2006.01) |

(52) U.S. Cl.
CPC *A24D 1/02* (2013.01); *A24D 1/002* (2013.01); *A24D 1/025* (2013.01); *A24D 3/00* (2013.01)

(58) Field of Classification Search
None
See application file for complete search history.

(56) References Cited

U.S. PATENT DOCUMENTS

| | | | |
|---|---|---|---|
| 2004/0123874 | A1 | 7/2004 | Zawadzki et al. |
| 2007/0295348 | A1 | 12/2007 | Wanna |
| 2008/0295854 | A1 | 12/2008 | Li et al. |
| 2011/0030709 | A1 | 2/2011 | Sebastian et al. |

FOREIGN PATENT DOCUMENTS

| | | | |
|---|---|---|---|
| JP | 2004-528838 | A | 9/2004 |
| JP | 2005-523389 | A | 8/2005 |
| JP | 2009-531056 | A | 9/2009 |
| WO | 03/088771 | A1 | 10/2003 |
| WO | WO-2011/012220 | A1 | 2/2011 |

OTHER PUBLICATIONS

International Search Report and Written Opinion of PCT/KR2012/010477, Apr. 29, 2013.

*Primary Examiner* — Richard Crispino
*Assistant Examiner* — Phu Nguyen
(74) *Attorney, Agent, or Firm* — McDermott, Will & Emery LLP

(57) ABSTRACT

A low ignition propensity cigarette paper includes a coating portion including a hydrophobic starch and a hydrophilic starch, and a plurality of pores including a micrometer-size pore and a nanometer-size pore, wherein the hydrophobic starch and the hydrophilic starch cover the micrometer-size pore and the nanometer-size pore.

7 Claims, 39 Drawing Sheets

LOW IGNITION PROPENSITY CIGARETTE PAPER AND CIGARETTE USING THE SAME

TECHNICAL FIELD

A low ignition propensity cigarette and a cigarette using the same are provided.

BACKGROUND ART

In general, in order to manufacture cigarettes, first, various kinds of leaf tobaccos are mixed and processed to get the desired flavor and taste. Next, the processed leaf tobaccos are cut to prepare cut tobacco leaves, and the cut tobacco leaves are wrapped with a cigarette paper to provide filter-less cigarette. Then, a filter is attached to the filter-less cigarette, if necessary.

A cigarette filter may include activated carbon, flavoring materials and the like, and may be composed of a mono-filter or a multi-filter, and the cigarette filter is surrounded by a cigarette filter wrapping paper. The cut tobacco leaves and the cigarette filter are connected with each other by a tipping paper, and the tipping paper may include fine holes.

A cigarette paper may be manufactured such that a target tar and a target nicotine may be carried out by appropriate porosity and combustibility during smoking, and may be manufactured such that smoke flavor which cigarettes intrinsically have may be imparted. The cigarette paper may be manufactured of flax, wood pulp and the like.

A material such as starch is coated on a low ignition propensity cigarette paper in the form of a band, and the porosity of the coated band is low. Accordingly, when the combustion of the cigarette reaches a band portion, the amount of oxygen inflow to the cut tobacco leaf is reduced, and thus, the cigarette may be extinguished.

The above information disclosed in this Background section is only for enhancement of understanding of the background of the invention and therefore it may contain information that does not form the prior art that is already known in this country to a person of ordinary skill in the art.

DISCLOSURE

Technical Problem

An exemplary embodiment may improve dryness of the coating composition and maintain a coating characteristic of the coating composition to a cigarette paper.

An exemplary embodiment may be used to achieve other problems which have not been specifically mentioned in addition to the problem.

Technical Solution

A low ignition propensity cigarette paper according to an exemplary embodiment includes a coating portion including a hydrophobic starch and a hydrophilic starch, and a plurality of pores including a micrometer-size pore and a nanometer-size pore, wherein the hydrophobic starch and the hydrophilic starch cover the micrometer-size pore and the nanometer-size pore.

In an exemplary embodiment, a mixing ratio of the hydrophilic starch and the hydrophobic starch may be about 18 wt % to about 22 wt %:about 8 wt % to about 12 wt %.

In an exemplary embodiment, the hydrophobic starch may include a metallic salt

A cigarette according to an exemplary embodiment includes a cigarette column portion, and a low ignition propensity cigarette paper surrounding the cigarette column portion and including a coating portion and a plurality of pores, wherein the coating portion includes a hydrophobic starch and a hydrophilic starch, the plurality of pores includes a micrometer-size pore and a nanometer-size pore, and the hydrophobic starch and the hydrophilic starch cover the micrometer-size pore and the nanometer-size pore.

In an exemplary embodiment, the cigarette may include a cigarette filter portion.

In an exemplary embodiment, the cigarette filter portion may include at least one filter member.

In an exemplary embodiment, the cigarette filter portion may include at least one of an adsorbent or a flavoring agent.

Advantageous Effects

Exemplary embodiments may improve dryness of the coating composition and may maintain a coating characteristic of the coating composition to a cigarette paper.

MODE FOR INVENTION

Figure 1:
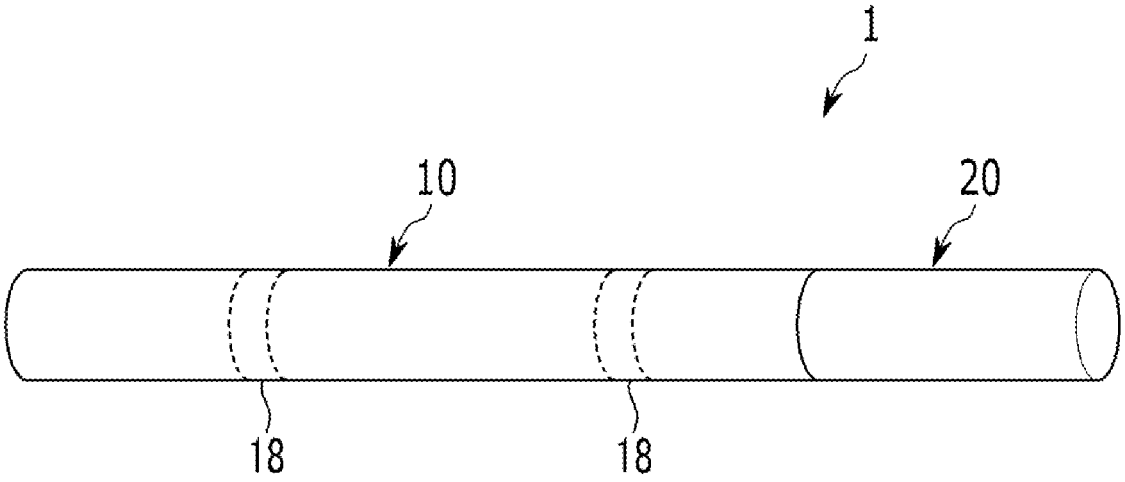
FIG. 1 is a perspective view schematically illustrating a cigarette according to an exemplary embodiment.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification In addition, the detailed description of the widely known technologies will be omitted.

Hereinafter, a cigarette paper and a cigarette according to exemplary embodiments will be described in detail with reference to FIGS. 1 to 3.

Figure 2:
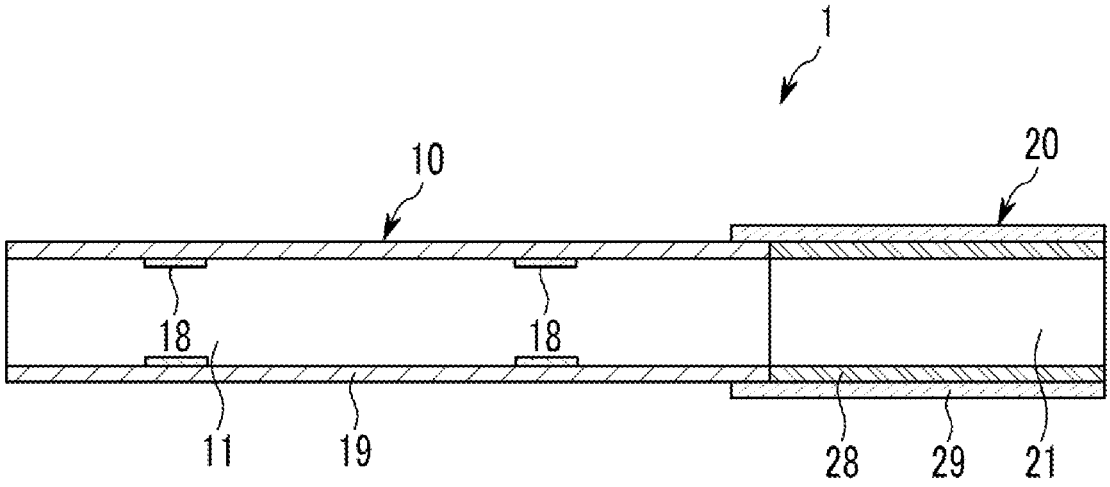
FIG. 2 is a cross-sectional view schematically illustrating a cigarette according to an exemplary embodiment.
Figure 3:
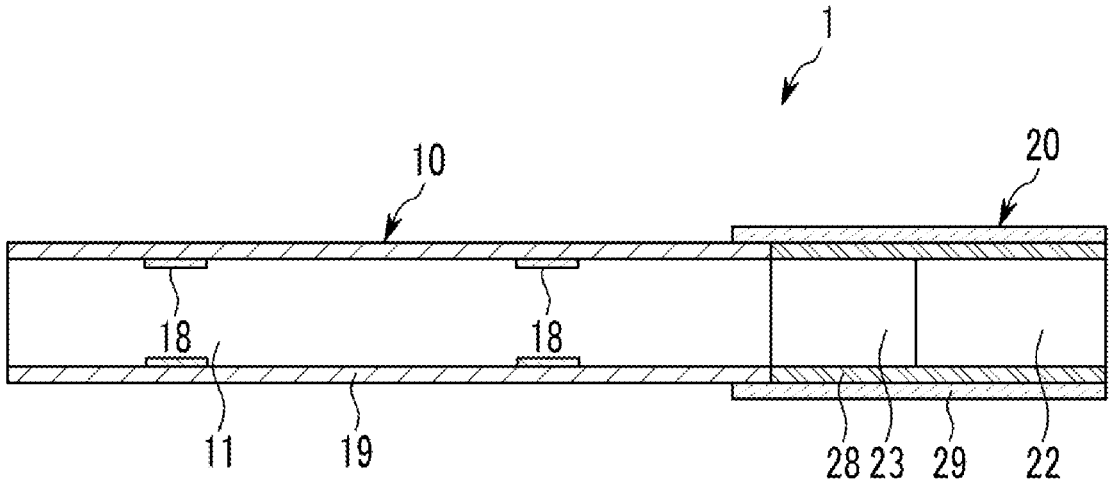
FIG. 3 is a cross-sectional view schematically illustrating a cigarette according to an exemplary embodiment.

FIG. 1 is a perspective view schematically illustrating a cigarette according to an exemplary embodiment, FIG. 2 is a cross-sectional view schematically illustrating a cigarette according to an exemplary embodiment, and FIG. 3 is a cross-sectional view schematically illustrating a cigarette according to an exemplary embodiment.

Referring to FIGS. 1 and 2, a cigarette 1 includes a cigarette column portion 10 combusted by fire and a cigarette filter portion 20 filtering cigarette smoke. The cigarette column portion 10 may be surrounded by a cigarette paper 19, and the cigarette filter portion 20 may be surrounded by a cigarette filter wrapping paper 28. The cigarette column portion 10 and the cigarette filter portion 20 may be connected with each other by a tipping paper 29 which may surround the cigarette column portion 10 and the cigarette filter portion 20. The circumference of the cigarette may be about 5 mm to about 30 mm. The cigarette filter portion 20 may be omitted.

The cigarette column portion 10 includes cut tobacco leaves 11 cut from leaf tobaccos processed by various methods.

The cigarette filter portion 20 may include a first filter portion 21. The first filter portion 21 may be formed of acetate tow, paper and the like. The cigarette filter portion 20 may be a multi-filter including two or more filter members. For example, referring to FIG. 3, the cigarette filter portion 20 includes a second filter portion 22 and a third filter portion 23. Besides, the cigarette filter portion 20 may include three filter members, four filter members, and multi-filter members.

The cigarette filter portion 20 may include an adsorbent, a flavoring agent and the like. For example, the adsorbent may be activated carbon and the like, and the flavoring agent may be an herb flavoring material and the like. In the multi-filter, one or more filter members may include at least one of the adsorbent or the flavoring agent. For example, referring to FIG. 3, at least one of the second filter portion 22 or the third filter portion 23 may include at least one of the adsorbent or the flavoring agent.

The cigarette paper 19 includes one or more coating portions 18. For example, the coating portion 18 may be in the form of a band, and may have various shapes instead of the form of a band. The number, thickness and shape of the coating portions 18 may be variously modified, and the interval of a plurality of coating portions 18 may be variously modified. The coating portion 18 may reduce the porosity of the cigarette paper 19, and accordingly, when the combustion of a cigarette reaches the coating portion 18, the amount of oxygen inflow to the cigarette column portion 10 is reduced and thus the cigarette 1 may be extinguished. The cigarette paper 19 including the coating portion 18 refers to a low ignition propensity cigarette paper. A coating composition is coated in the coating portion 18. For example, the porosity of the cigarette paper 19 may be approximately 85 cu or less, and the porosity of the coating portion 18 may be approximately 5 cu to approximately 20 cu. The thickness of the base paper of the cigarette paper may be about 30 micrometers to about 60 micrometers, and the basis weight of the base paper may be about 15 $g/m^2$ to about 40 $g/m^2$. The thickness of the coating portion 18 may be about 5 micrometers or less, and the basis weight of the coating portion 18 may be about 15 $g/m^2$ or less. The weight ratio of the coating composition based on the entire weight of the cigarette paper 19 and the coating composition may be approximately 40 wt % or less. When the coating portion 18 is in the form of a band, the weight of the coating composition per band may be approximately 2.5 mg or less.

The coating composition may include hydrophilic starch and hydrophobic starch. A mixing ratio of the hydrophilic starch and the hydrophobic starch may be about 18 wt % to about 22 wt %:about 8 wt % to about 12 wt %, and within this range, dryness of the coating composition may improve, and may maintain a coating characteristic of the coating composition to a cigarette paper. In addition, when the hydrophobic starch treated with a metallic salt such as an aluminum salt or a calcium salt is used, dryness of the coating composition may further improve, and may further maintain a coating characteristic of the coating composition to a cigarette paper.

When the hydrophilic starch and the hydrophobic starch are mixed with each other in the coating composition, the hydrophilic starch in a composite may be important to the increase of the porosity, and the porosity may be adjusted by an appropriate mixing of the hydrophilic starch and the hydrophobic starch.

When the hydrophilic starch and the hydrophobic starch are mixed with each other in the coating composition, an elastic modulus may decrease a little bit, but an elongation ratio may increase about twice as times. However, when the hydrophilic starch or the hydrophobic starch is solely used, an elongation ratio may increase a little bit. For example, when about 20 wt % hydrophilic starch and about 10 wt % hydrophobic starch are mixed with each other, an elongation ratio may be maximized. In addition, a brittle characteristic may occur because of the increase of the elastic modulus when contents of starch increase in the coating composition.

The hydrophobic starch in the coating composition has weak pore controllability, and the hydrophilic starch has strong pore controllability but the hydrophilic starch mixed with the hydrophobic starch may have stronger pore controllability. For example, a mixture of about 20 wt % hydrophilic starch and about 10 wt % hydrophobic starch may have the strongest pore controllability.

When the coating composition is coated on the cigarette paper, the hydrophobic starch has about 10 micrometers to about 20 micrometers of particle diameter, and accordingly, the hydrophobic starch may control large micrometer-size pores efficiently. The hydrophilic starch shows a fluidic characteristic, and accordingly, the hydrophilic starch may control small nanometer-size pores efficiently. However, when the hydrophobic starch is used alone, the hydrophobic starch is formed as a stacked structure on the cigarette paper, and accordingly, it may be difficult to control nanometer-size pores. When the hydrophilic starch is used alone, a phase difference on the surface of the cigarette paper may occur.

Dryness of the coating composition when the hydrophilic starch and the hydrophobic starch are mixed may be greater than dryness of the coating composition when the hydrophilic starch or the hydrophobic starch is solely used. Further, dryness of the coating composition may improve when contents of the hydrophobic starch increase.

Hereinafter, the present invention will be described in more detail with reference to Examples, but the following Examples are just the examples of the present invention and the present invention is not limited thereto.

In order to analyze particle sizes and characteristics of starch in the cigarette paper, a zeta potential analyzer and a particle size analyzer (ELS-Z2) are used. In order to analyze a specific surface area and a pore distribution chart, B.E.T (Tristar, Brunauer-Emmett-Teller isotherm) is used. In order to analyze the starch morphology coated on a surface of the cigarette paper and the cigarette paper morphology, a scanning electron microscope (Magellan) is used.

Cigarette Paper Characteristics

Figure 4:
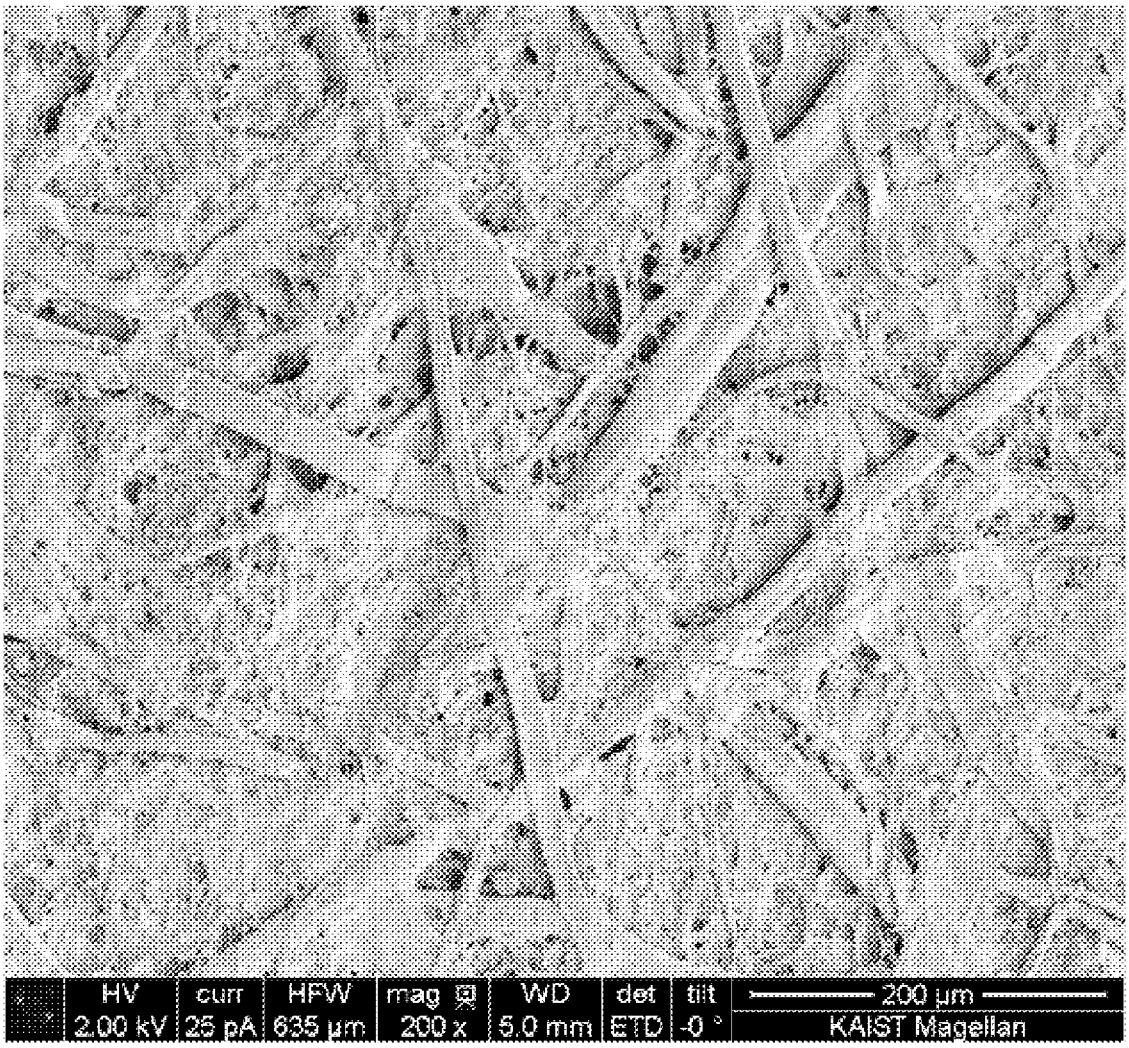
FIG. 4 and FIG. 5 are SEM photographs of the cigarette paper.
Figure 5:
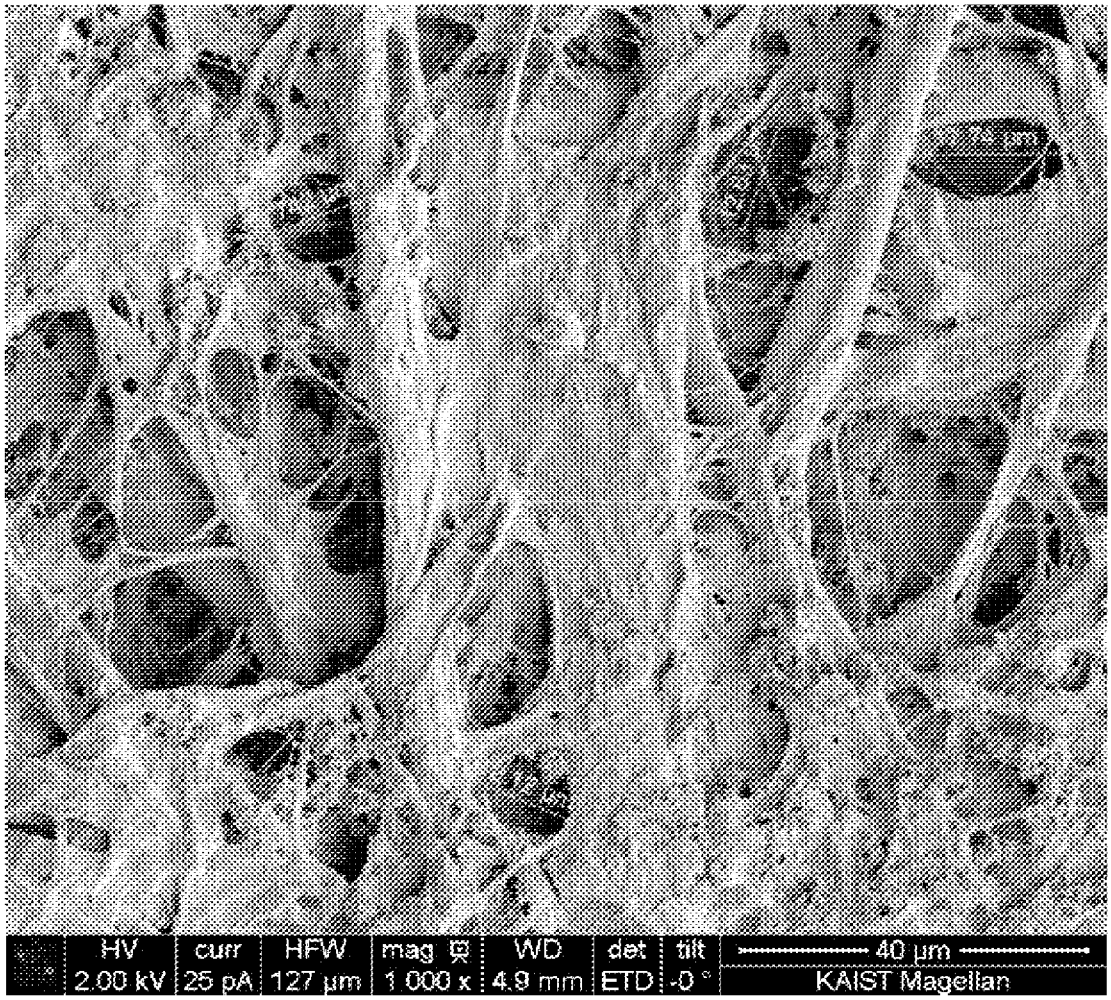
Figure 6:
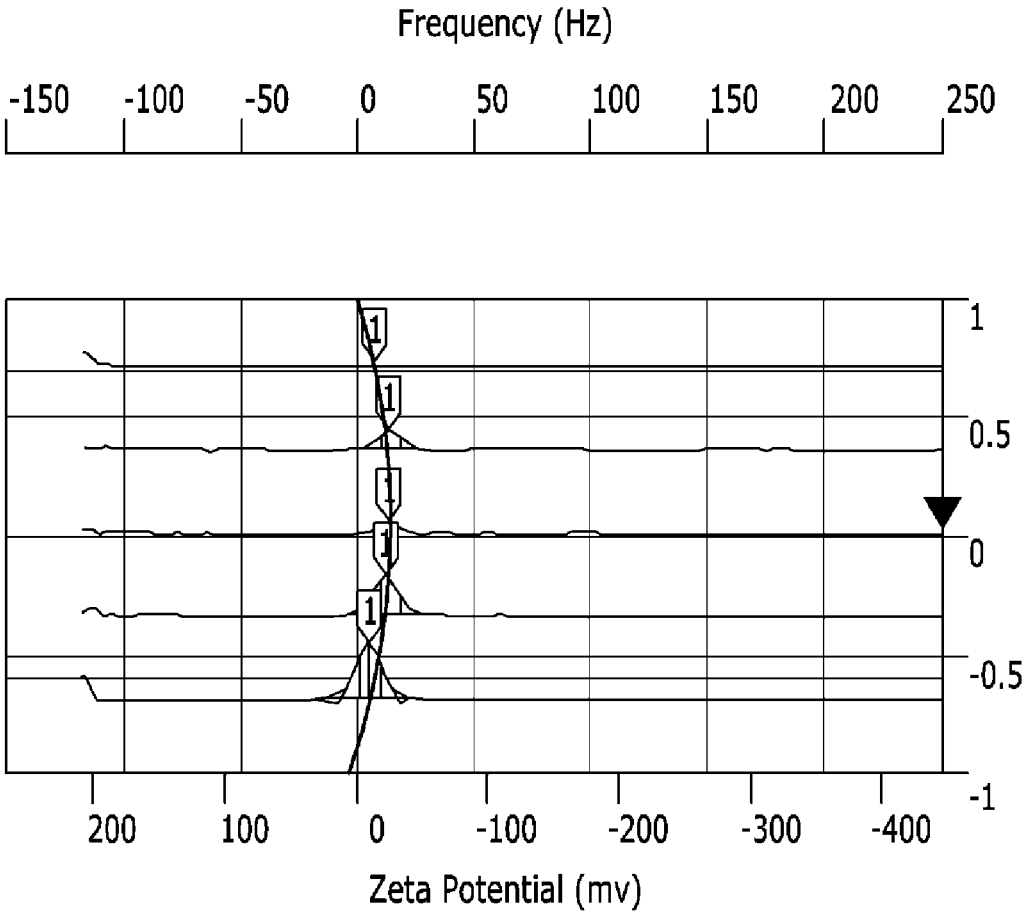
FIG. 6 is a graph showing surface charges of the cigarette paper.

In order to analyze characteristics of the cigarette paper, SEM photographs of the cigarette paper are taken and shown in FIG. 4 and FIG. 5, and surface charges of the cigarette paper are measured and shown in FIG. 6. Referring to FIG. 5, about 10 micrometers to about 20 micrometers of micrometer-size pores and about 15 nanometers of nanometer-size pores are disposed between cellulosic fibers, and thus, the appropriate control of the two kinds of pores may influence characteristics of the low ignition propensity cigarette paper. Referring to FIG. 6, a surface charge of the cigarette paper is about −13.88 as a negative charge, and it is shown that surface charges of the cigarette paper are distributed uniformly.

Starch Characteristics

Figure 7:
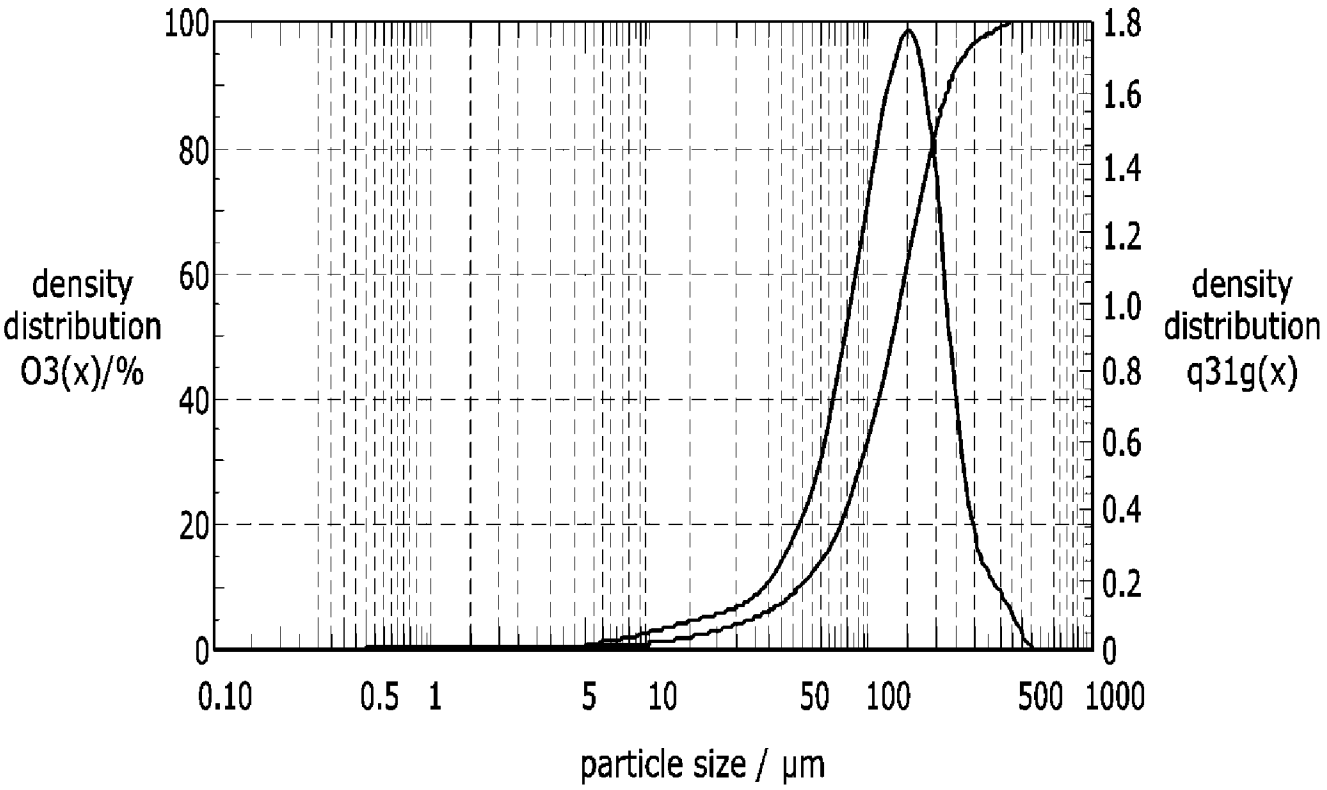
FIG. 7 is a graph showing particle sizes of the hydrophobic starch substituted with an aluminum group.
Figure 8:
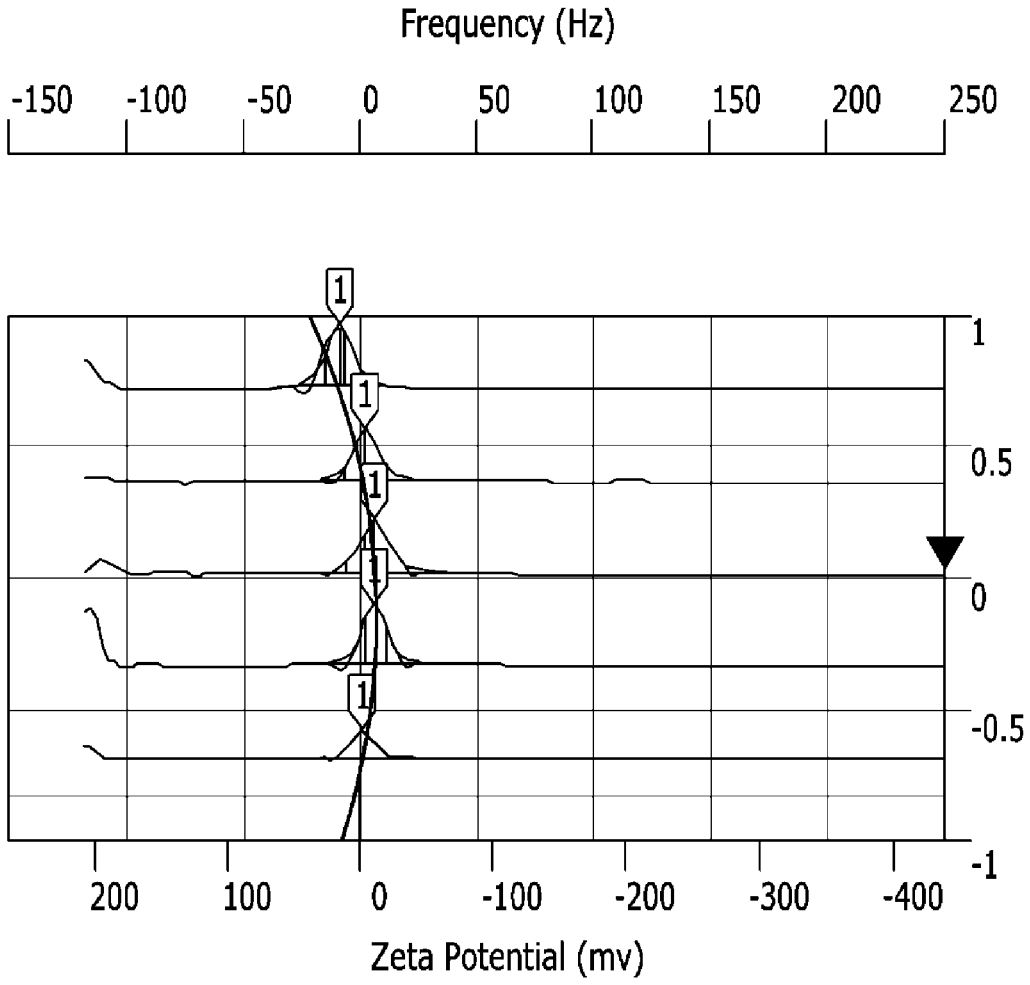
FIG. 8 is a graph showing charges of the hydrophobic starch substituted with an aluminum group.

Sunflow (Samyang Genex) is used as the hydrophobic starch. After the hydrophobic starch is treated with an aluminum salt, particle sizes and surface charges of the aluminum-group substituted hydrophobic starch are measured and shown in FIG. 7 and FIG. 8, respectively. Referring to FIG. 7, particle sizes of the aluminum-group substituted hydrophobic starch are about 87.54 micrometers with reference to SMD (surface area diameter), and surface charges thereof are about (+) 4.69 as positive charges.

Starch Pre-Treatment

Figure 9:
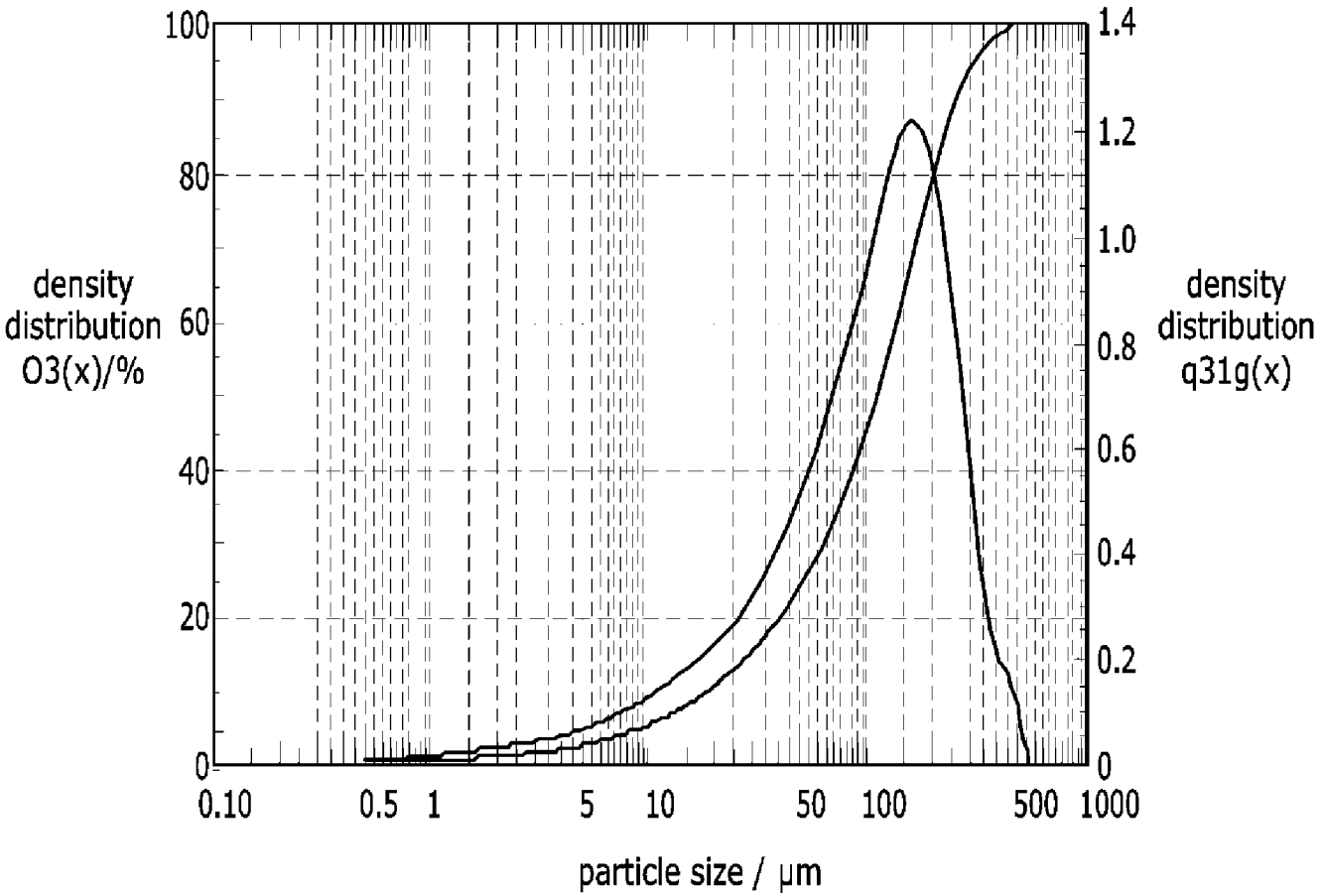
FIG. 9 is a graph showing particle sizes of the hydrophobic starch frozen and crushed.
Figure 10:
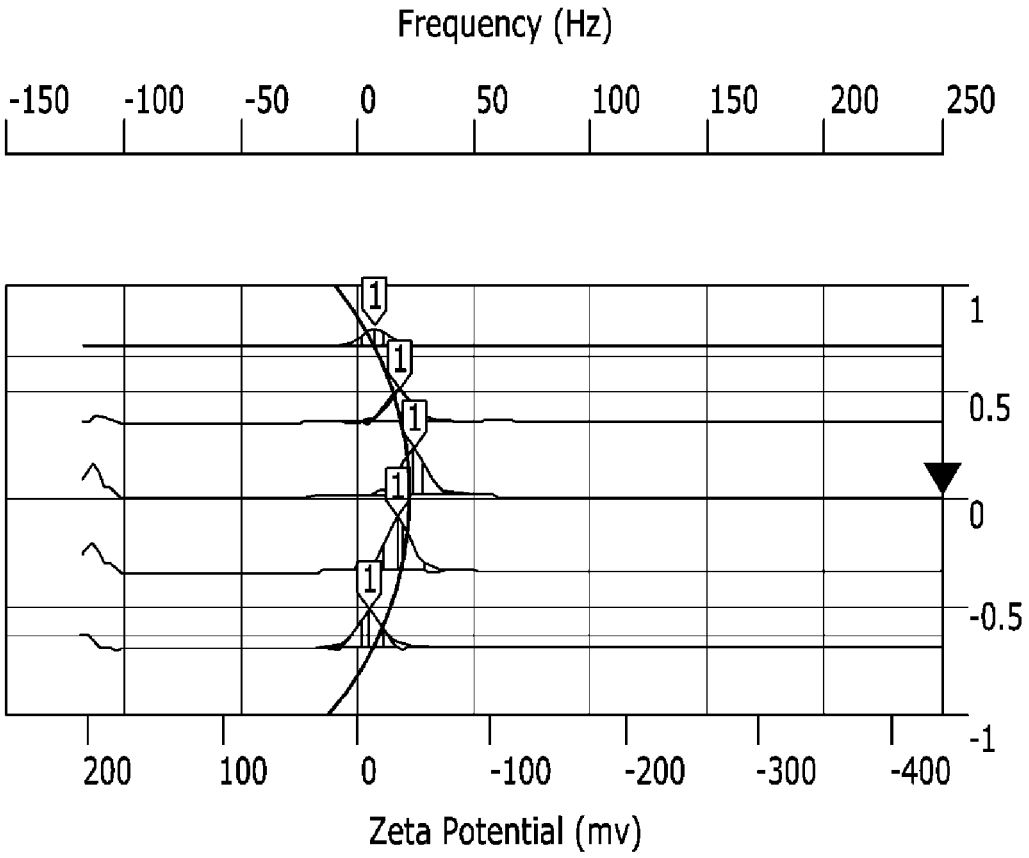
FIG. 10 is a graph showing charges of the hydrophobic starch frozen and crushed.
Figure 11:
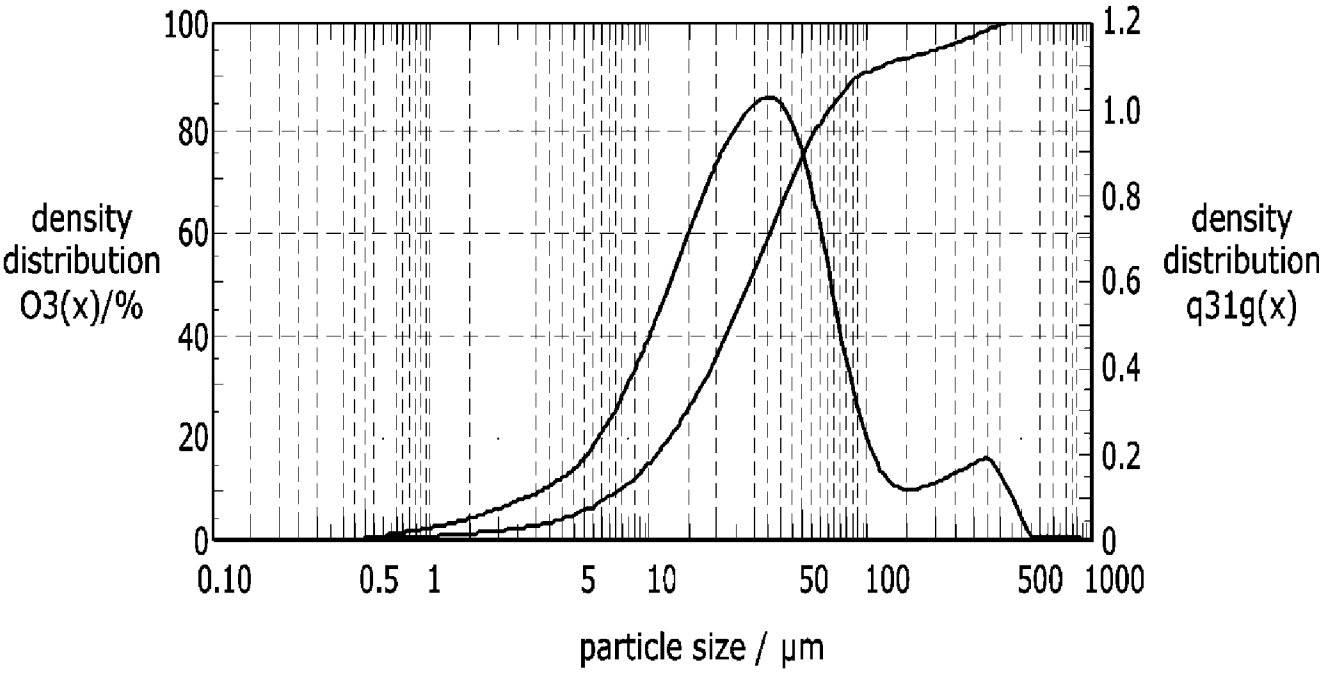
FIG. 11 to FIG. 14 are micrometer-unit graphs showing particle sizes of the frozen and crushed hydrophobic starch ultrasonicated for 10, 20, 30, and 60 minutes, respectively.
Figure 12:
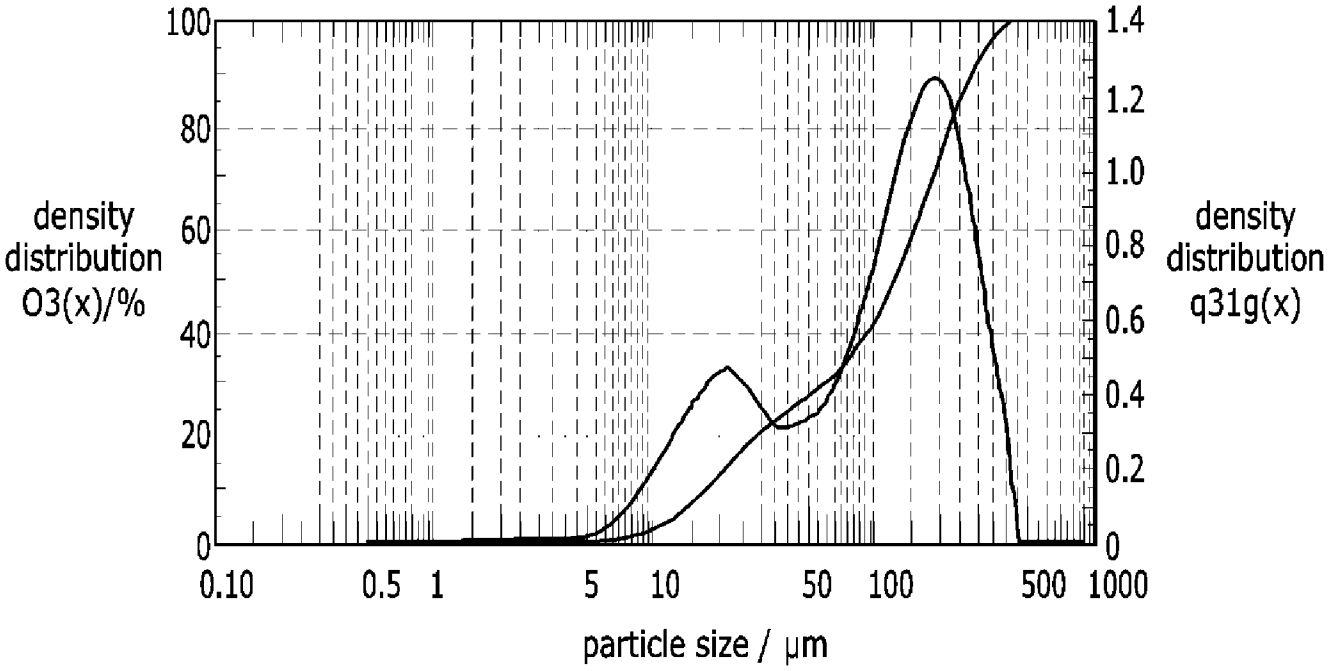
Figure 13:
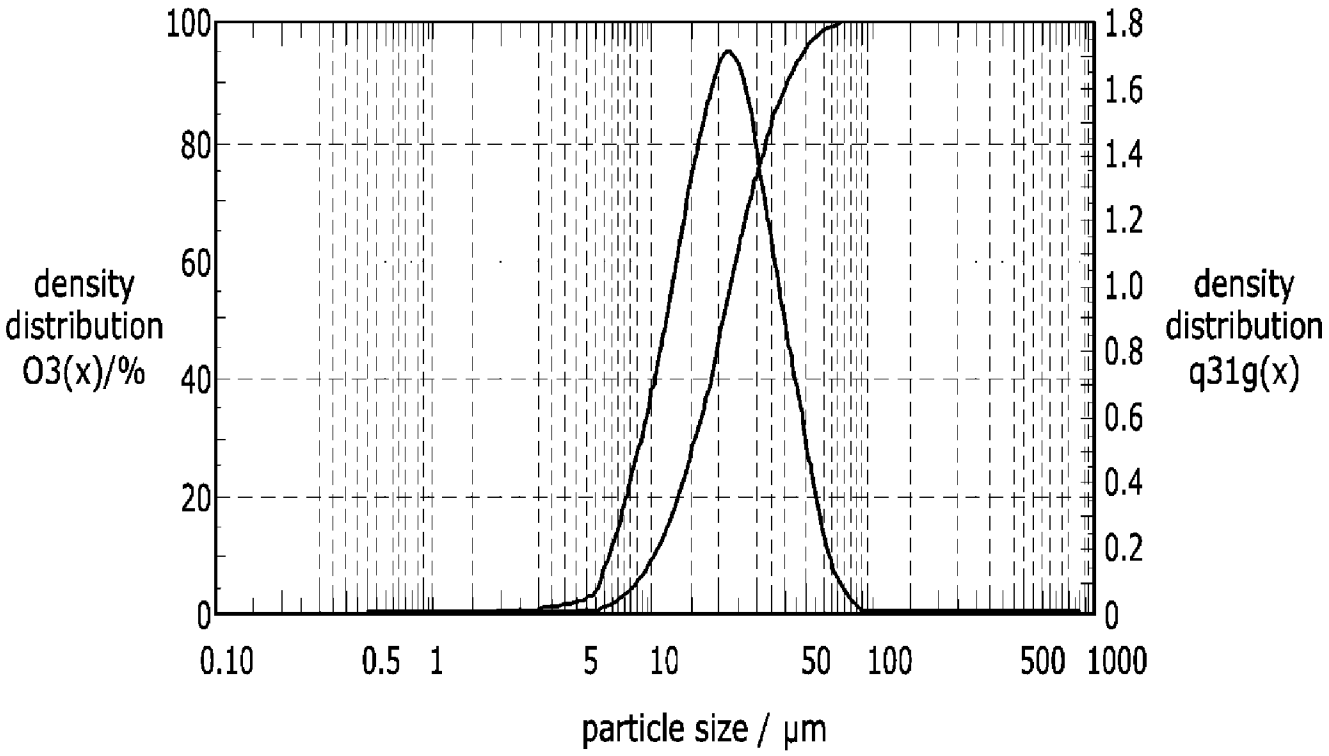
Figure 14:
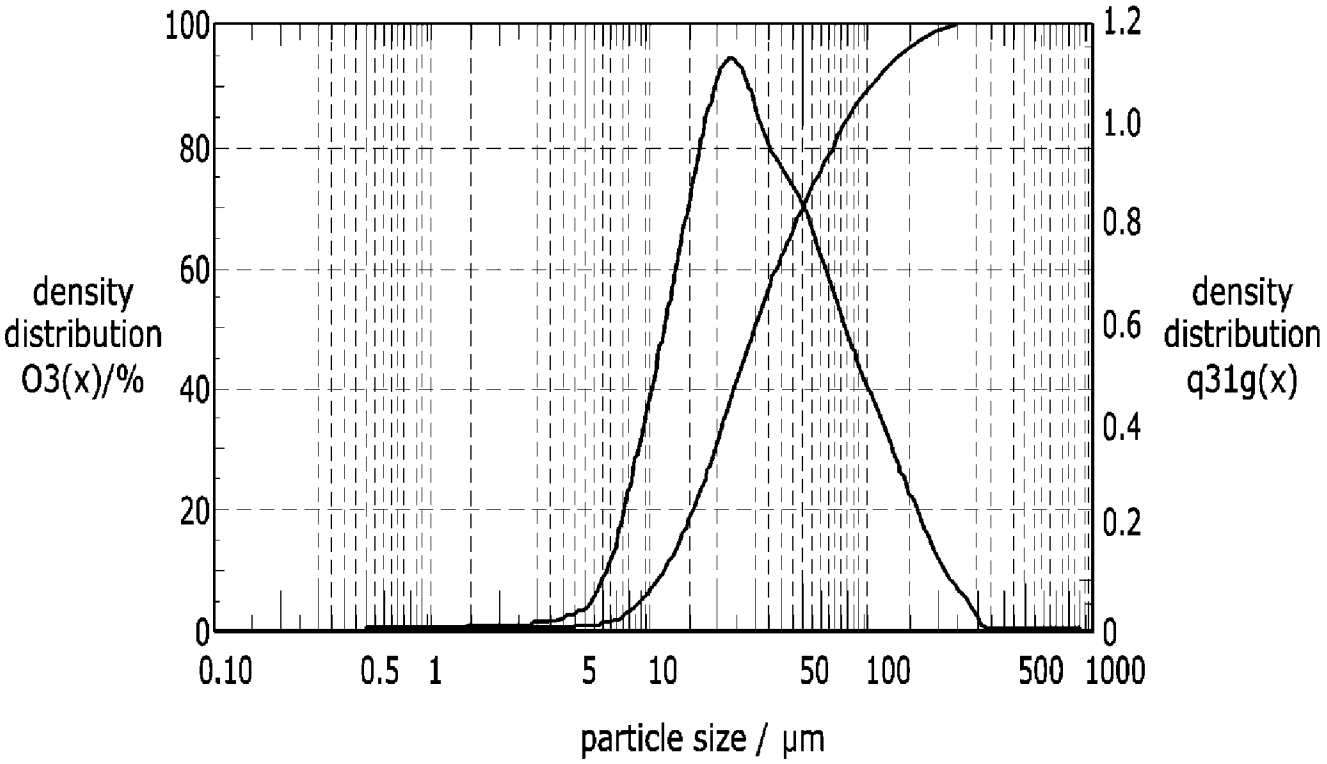

Because particle sizes of the aluminum-group substituted hydrophobic starch are larger than pore sizes of the cigarette paper, the aluminum-group substituted hydrophobic starch are frozen and crushed, and then ultrasonicated so that particle sizes of the hydrophobic starch may decrease. For example, the hydrophobic starch is frozen by nitrogen liquid, and then crushed physically. In this case, particle sizes of the hydrophobic starch about 37.53 micrometers as shown in FIG. 9, surface charges of the hydrophobic starch are about (−) 14.88 as negative charges.

Figure 15:
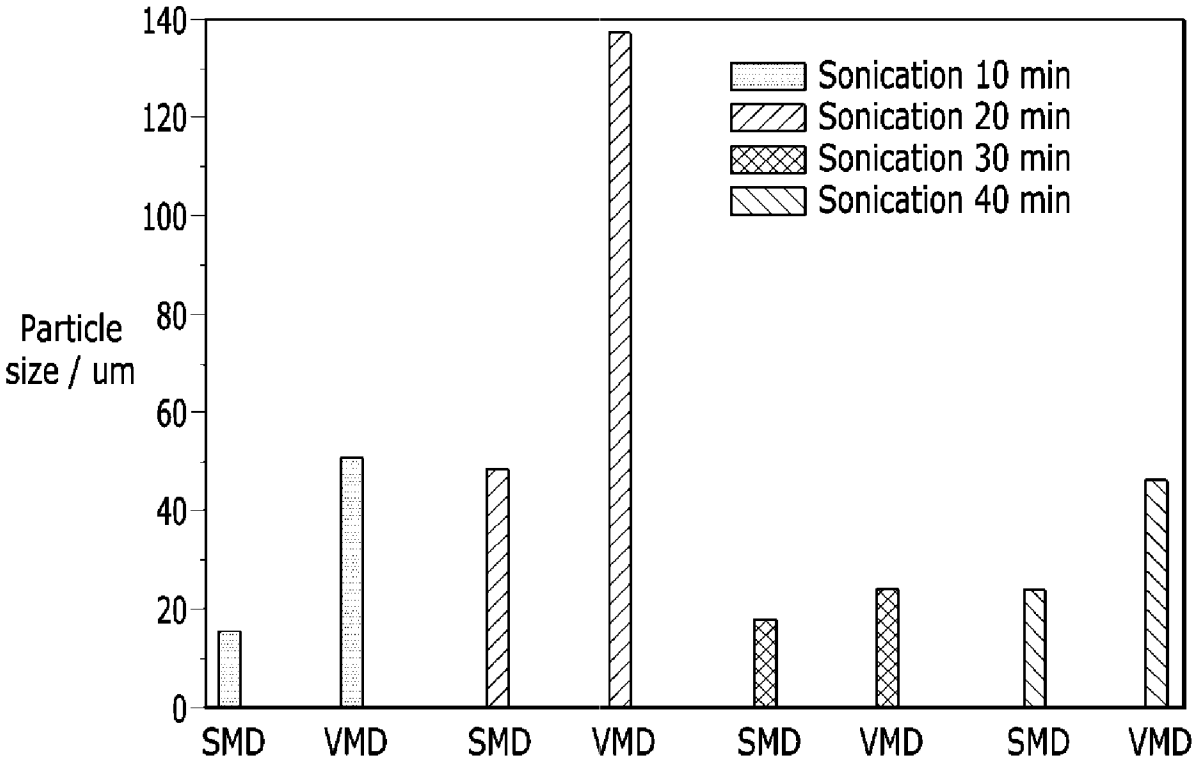
FIG. 15 is a graph of SMD and VMD showing particle sizes of the frozen, crushed, and ultrasonicated hydrophobic starch.

Because the frozen and crushed hydrophobic starch has still large particle sizes, it may be difficult to control the porosity of the cigarette paper. Accordingly, the frozen and crushed hydrophobic starch is treated with an ultrasonic wave for about 10, 20, 30 and 60 minutes, and then, each particle size is measured as a micrometer unit and shown in FIGS. 11 to 14, and particle sizes with reference to SMD (surface mean diameter) and VMD (volume mean diameter) are shown in FIG. 15. Referring to FIGS. 11 to 15, a particle size with the 10-minute ultrasonification is about 15.75 micrometers, a particle size with the 20-minute ultrasonification is about 48.89 micrometers, a particle size with the 30-minute ultrasonification is about 18.43 micrometers, and a particle size with the 60-minute ultrasonification is about 24.23 micrometers. Accordingly, when the frozen and crushed hydrophobic starch is ultrasonificated for about 10 minutes, particle sizes of the hydrophobic starch are small enough so that the porosity of the cigarette paper may be controlled efficiently.

Specimen Manufacture

After adding the hydrophilic starch to water and stirring at about 1000 rpm/min for about 4 hours, a paste is obtained. After adding the hydrophobic starch to the paste and stirring, a composite is obtained. After coating the composite on the paper at about 25 micrometers thickness, a specimen is prepared. Here, various content ratios of the hydrophilic starch and the hydrophobic starch may be applied to the specimen. α-waxy corn starch (Daesang Starch) is used as hydrophilic starch. The hydrophobic starch is treated with the aluminum-group substitution, freezing and crushing, and about 10-minute ultrasonification sequentially. Hereinafter, the manufactured specimen is analyzed about viscosity, strength, porosity, morphology, and dryness.

Viscosity

In order to analyze viscosity, a viscometer (SV-10) is used with reference to 50 mL.

Figure 16:
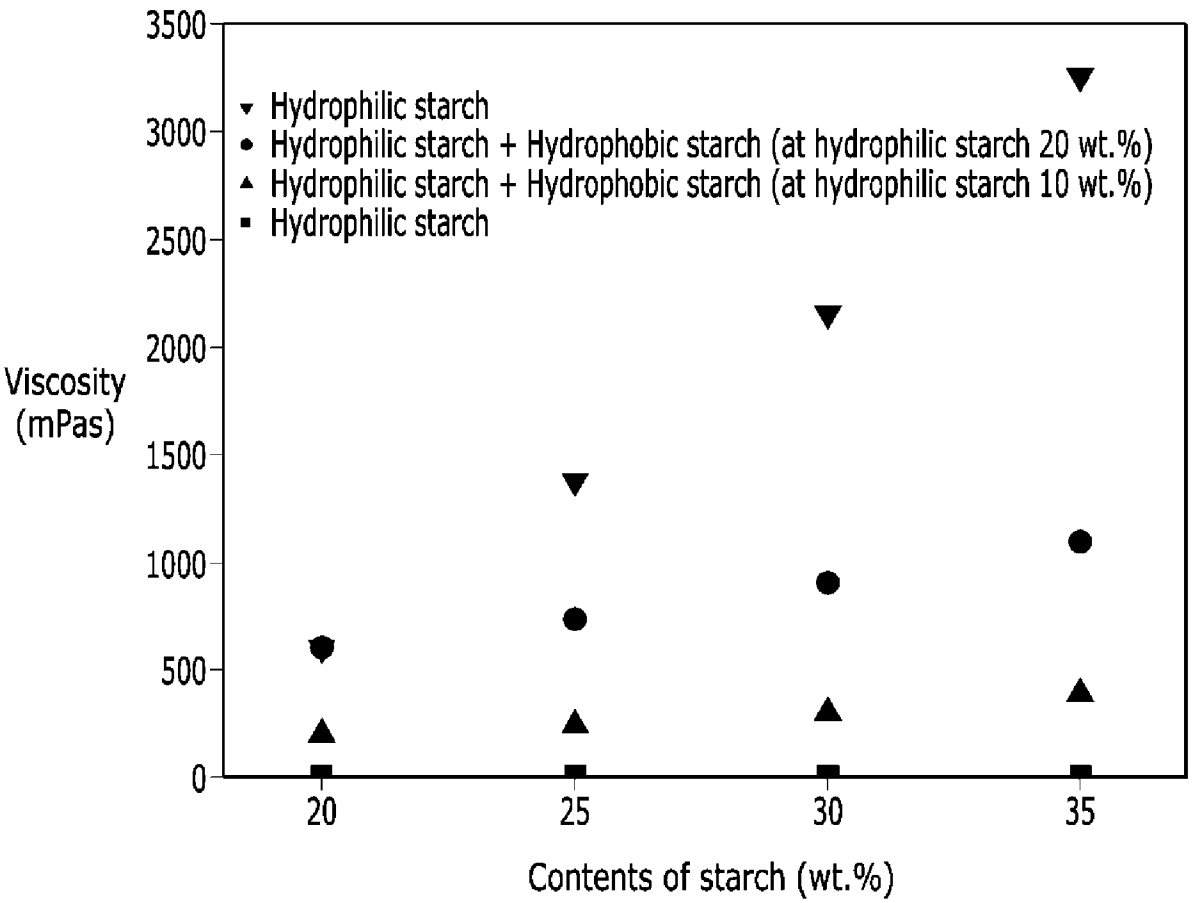
FIG. 16 is a graph showing viscosity changes according to contents of starch.

FIG. 16 is a graph showing viscosity changes according to contents of starch. Referring to FIG. 16, the hydrophobic starch solely used in the coating composition may scarcely influence viscosity of the coating composition, but the hydrophilic starch solely used in the coating composition may influence viscosity of the coating composition, in other words, viscosity of the coating composition increases when contents of the hydrophilic starch increases. When the hydrophilic starch and the hydrophobic starch are mixed with each other, viscosity increases according to the increase of contents of the hydrophilic starch at a constant content of the hydrophobic starch, and viscosity also increases according to the increase of contents of the hydrophobic starch at a constant content of the hydrophilic starch. Accordingly, viscosity may be appropriately adjusted by controlling mixture ratios of the hydrophilic starch and the hydrophobic starch.

Tensile Strength

In order to analyze tensile strength of coating materials, a tensile tester (AG-5000G, Universal Testing Machine) is used based on ASTM D638, and a speed of the cross head is about 0.3 mm/min, a load is about 50 kg.

When the elastic modulus of the cigarette paper coated with the coating composition decreases and the elongation ratio thereof increases, a coating process with high speed is more efficient.

Figure 17:
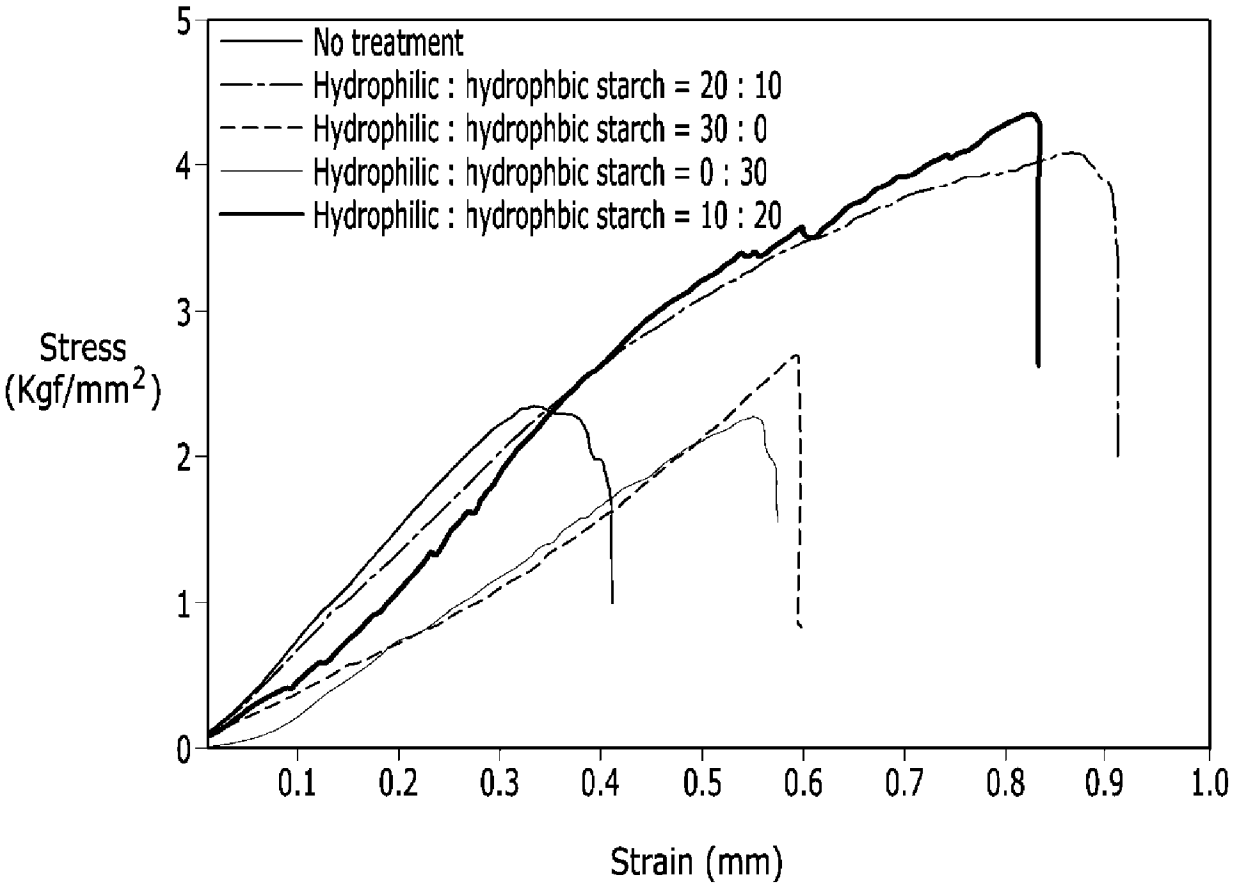
FIG. 17 is a stress-strain graph of the cigarette paper.

FIG. 17 is a stress-strain graph of the cigarette paper, and Young's modulus and elongation are shown in Table 1. The cigarette paper which is not coated by the coating composition has about 0.4 mm elongation. When the hydrophobic starch or the hydrophilic starch is solely coated on the cigarette paper, Young's modulus of the cigarette paper decreases and elongation of the cigarette paper increases a little bit. However, when a mixture of the hydrophobic starch and the hydrophilic starch is coated on the cigarette paper, Young's modulus of the cigarette paper decreases a little bit and elongation of the cigarette paper increases as two times as the cigarette paper without the coating treatment. When the hydrophobic starch or the hydrophilic starch is solely coated on the cigarette paper, Young's modulus increases according to the increase of contents of starch so that a brittle characteristic may increase and elongation may decrease. Accordingly, referring to FIG. 17 and Table 1, mixing about 20 wt % hydrophilic starch with about 10 wt % hydrophobic starch may be an optimum condition in a coating process with high speed.

TABLE 1

| Sample (Hydrophilic:Hydrophobic starch) | Young's modulus ($Kgf/mm^2$) | Elongation (%) |
|---|---|---|
| No treatment | 7.45 | 1.73 |
| 20:10 | 6.76 | 4.34 |
| 30:0 | 6.27 | 2.79 |
| 0:30 | 4.34 | 2.97 |
| 10:20 | 5.08 | 4.15 |

Porosity

In order to analyze the pore controllability, an air permeability tester (A-10) is used.

Figure 18:
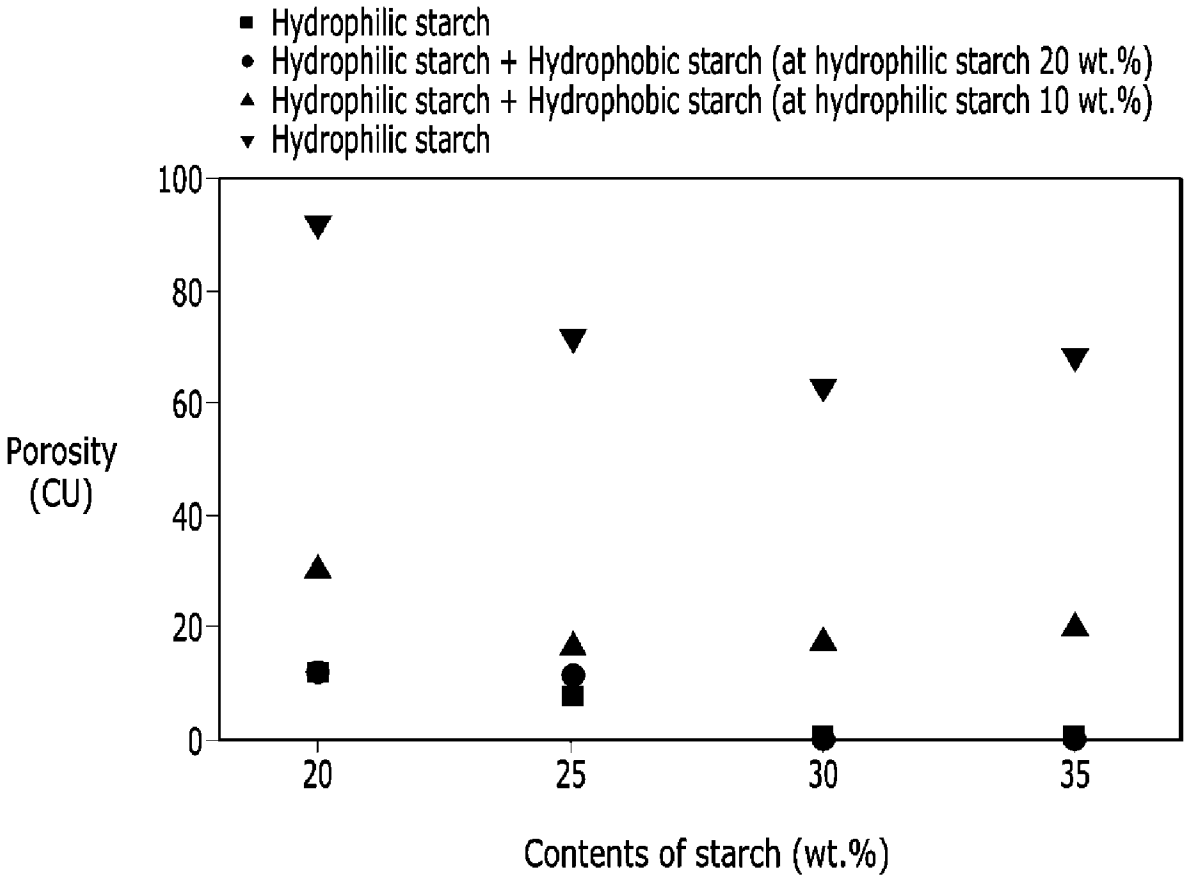
FIG. 18 and FIG. 19 are graphs showing porosity changes according to contents of starch.
Figure 19:
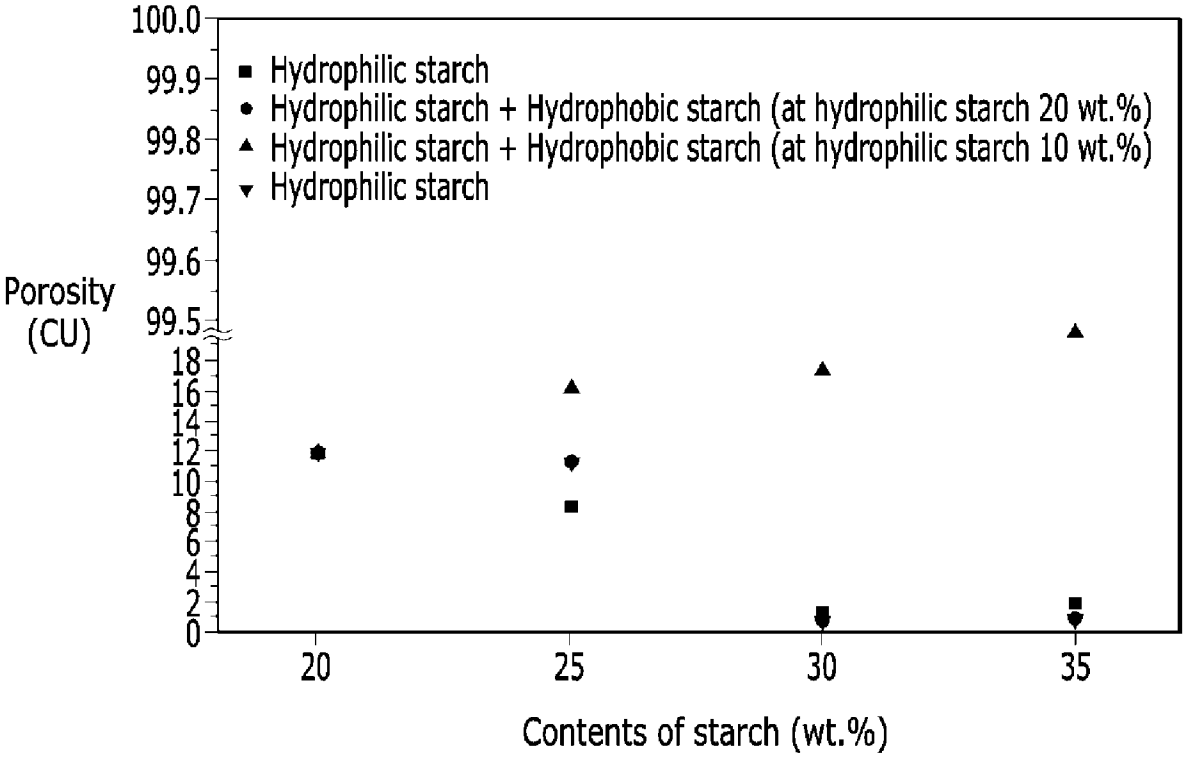
Figure 20:
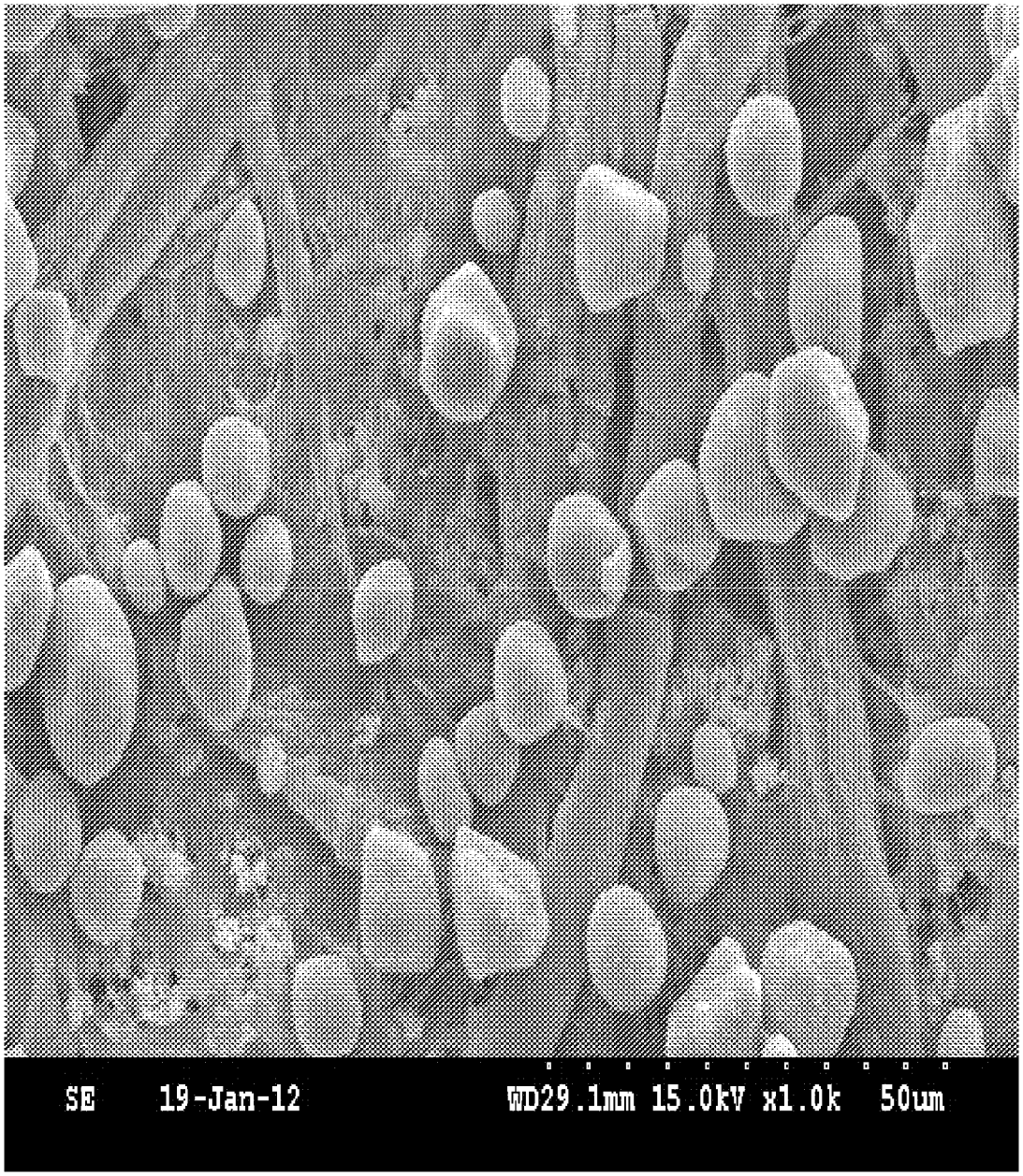
FIGS. 20 to 23 are SEM photographs of the cigarette papers when 20 wt %, 25 wt %, 30 wt %, and 35 wt % of hydrophobic starch is solely used, respectively.
Figure 21:
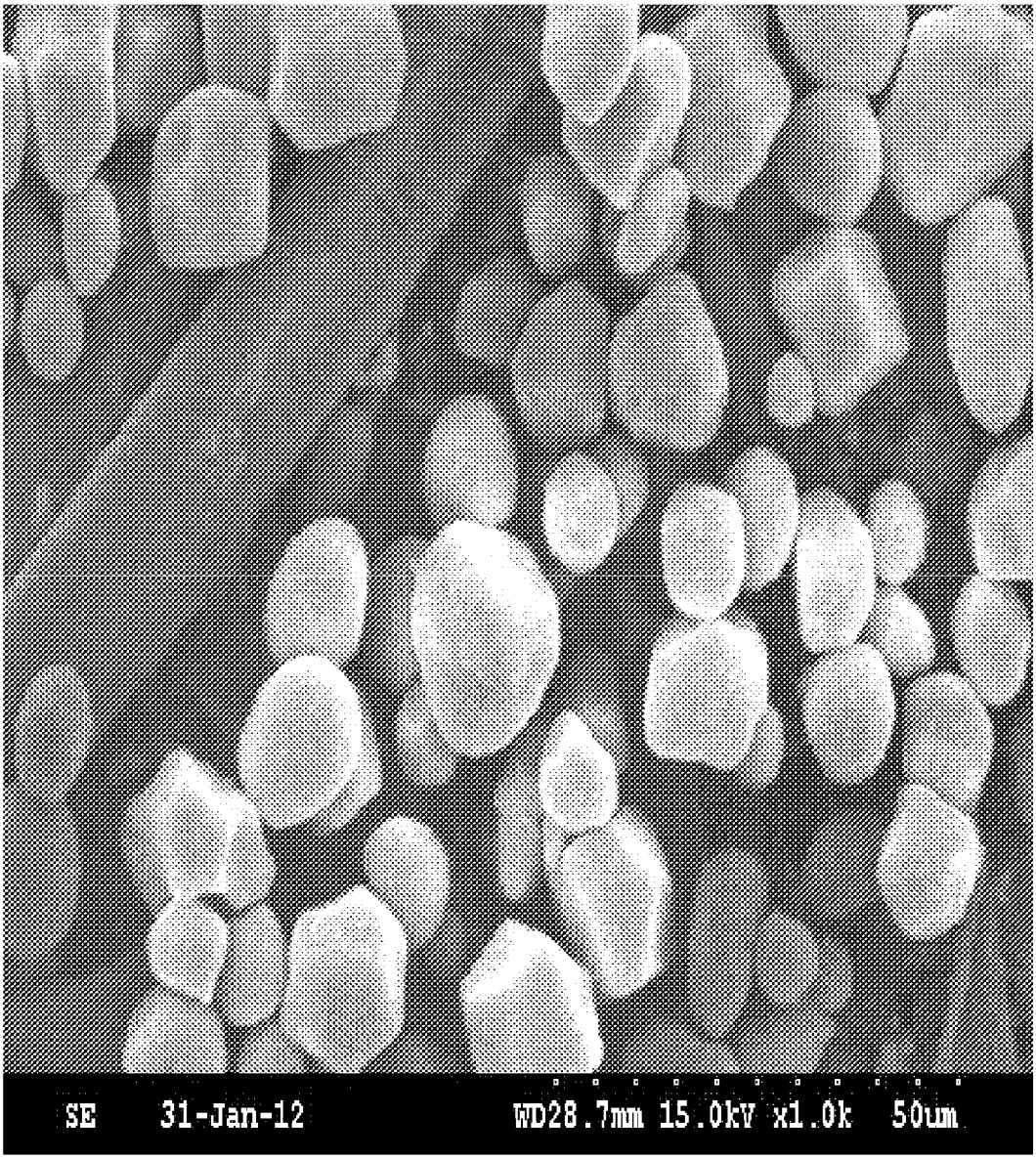
Figure 22:
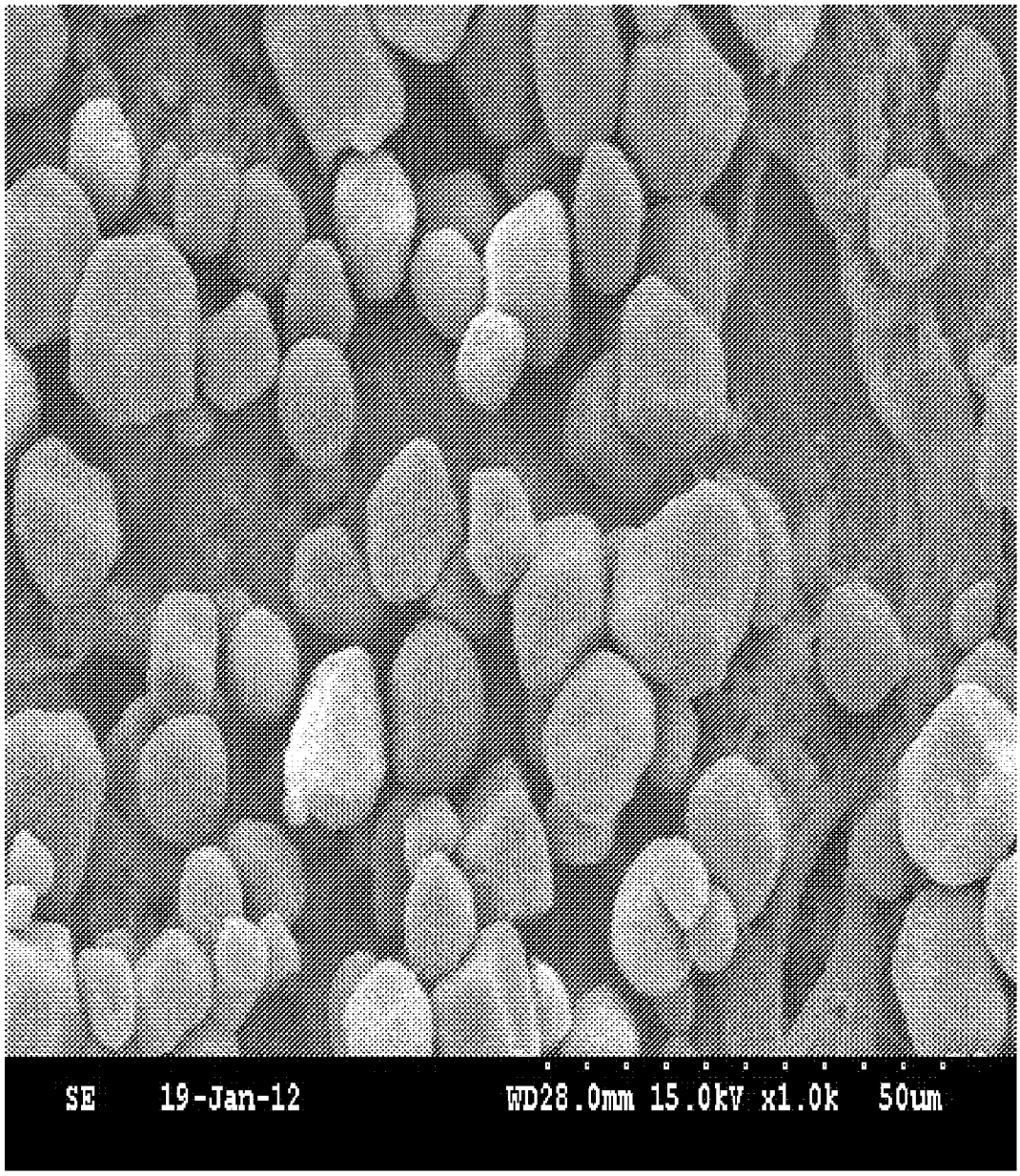
Figure 23:
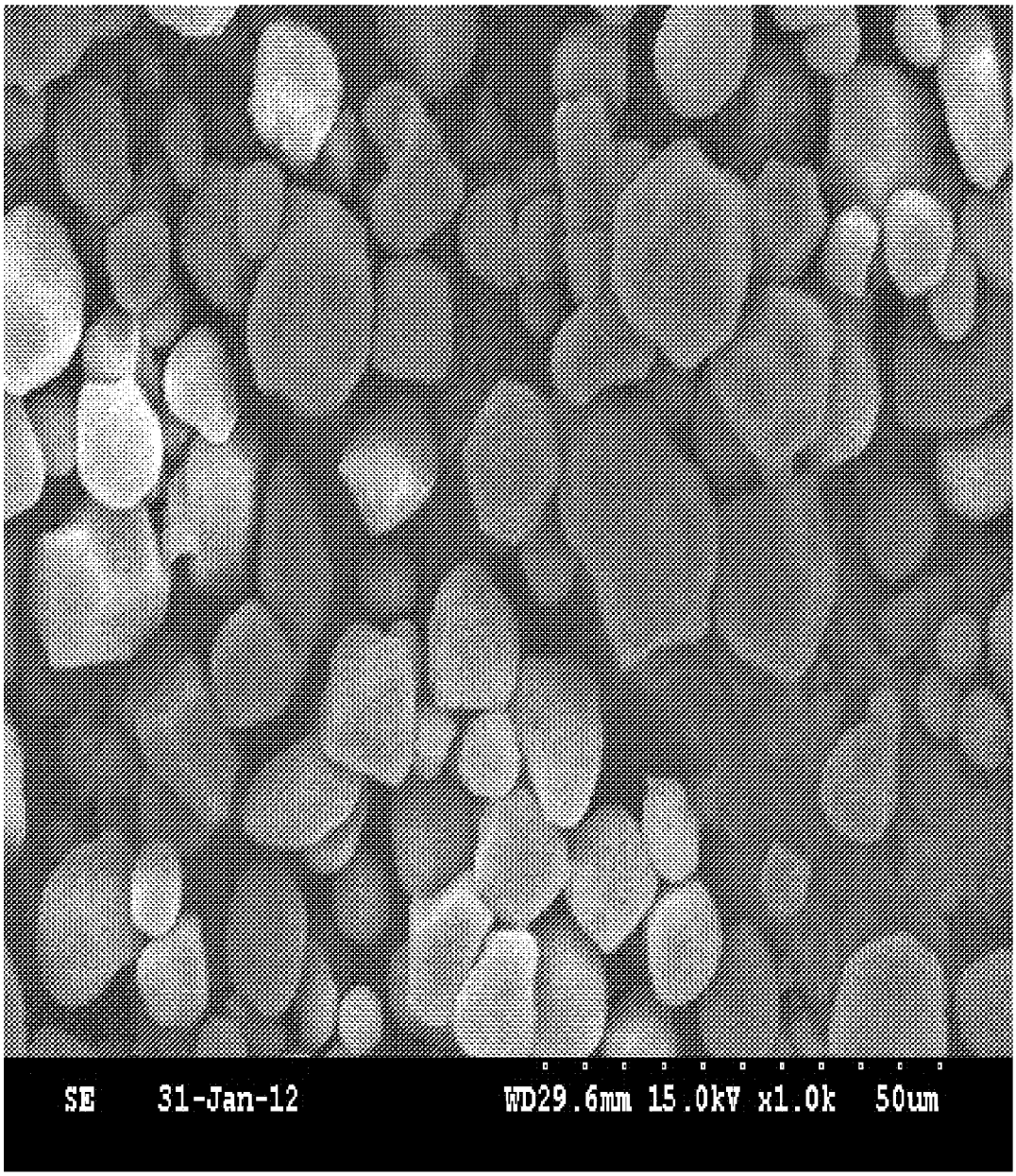
Figure 24:
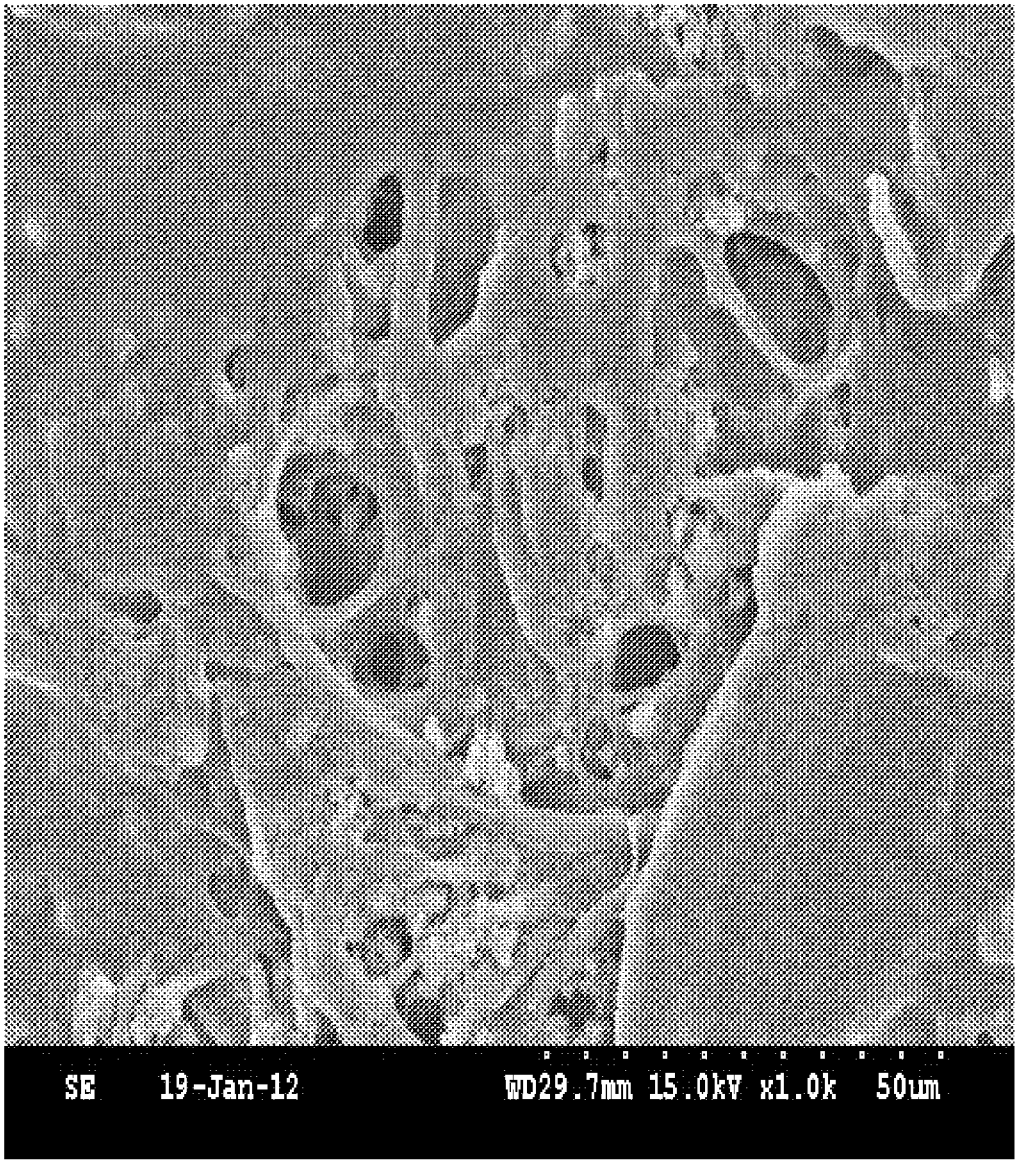
FIGS. 24 to 27 are SEM photographs of the cigarette papers when 20 wt %, 25 wt %, 30 wt %, and 35 wt % of hydrophilic starch is solely used, respectively.
Figure 25:
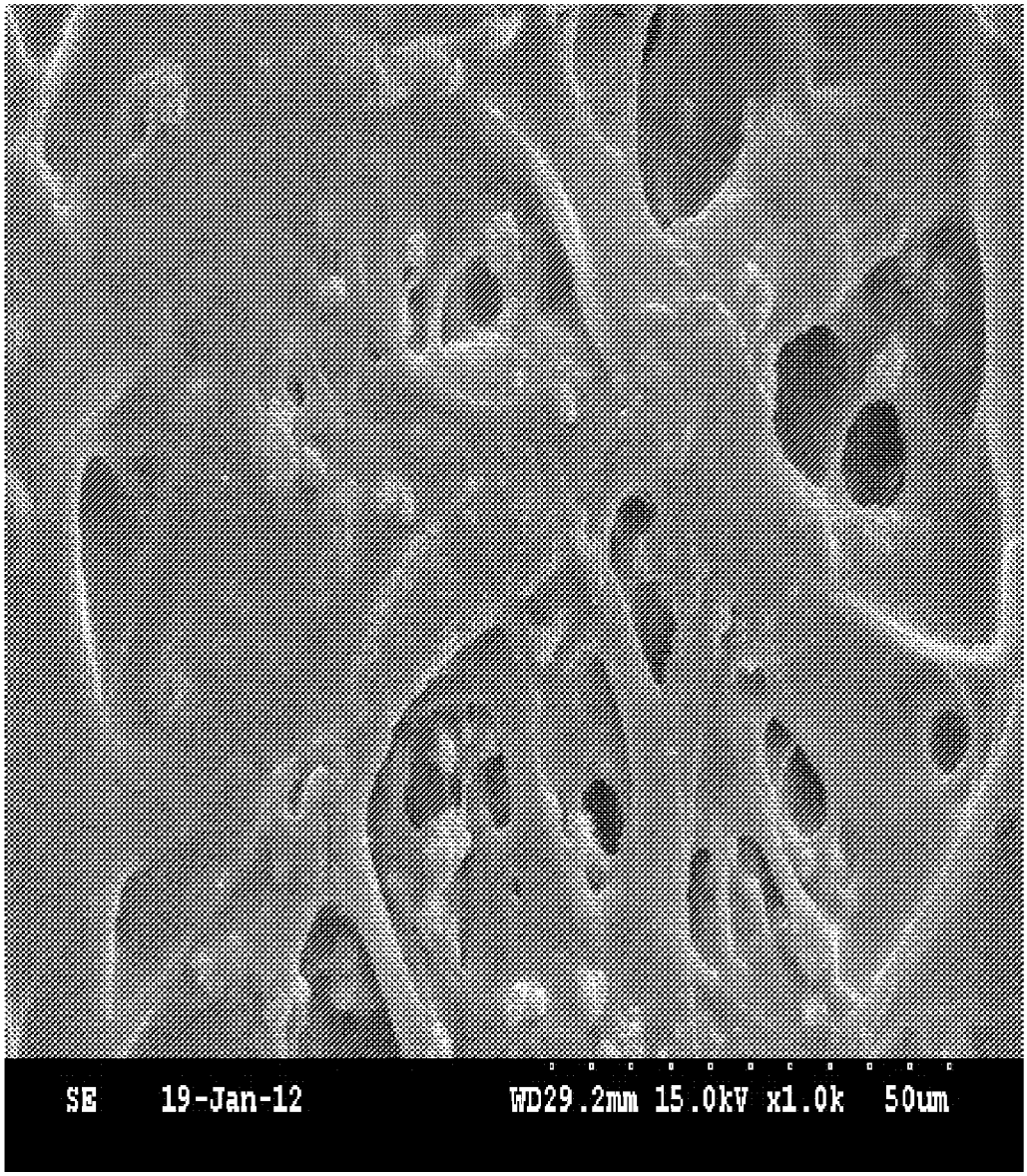
Figure 26:
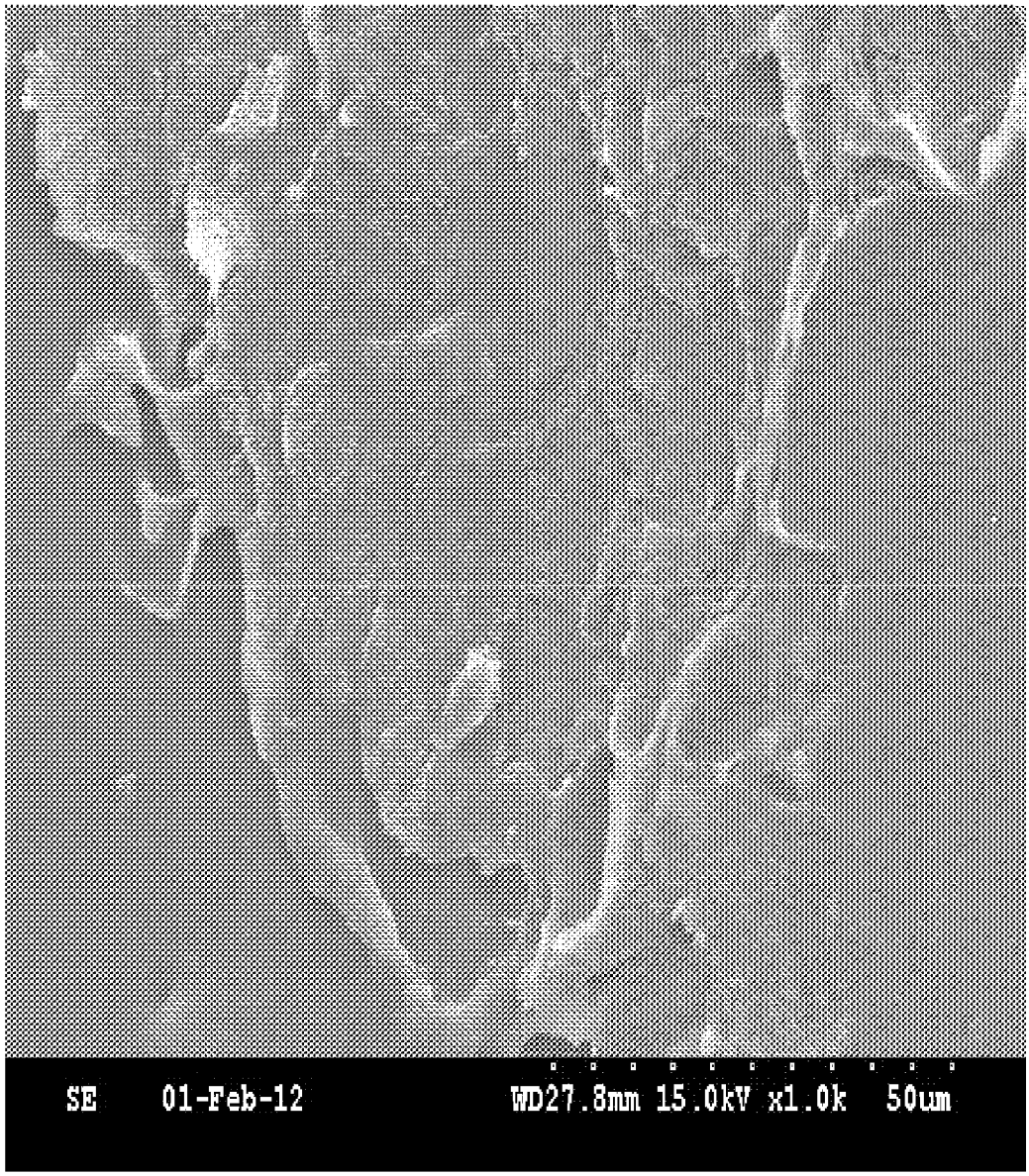
Figure 27:
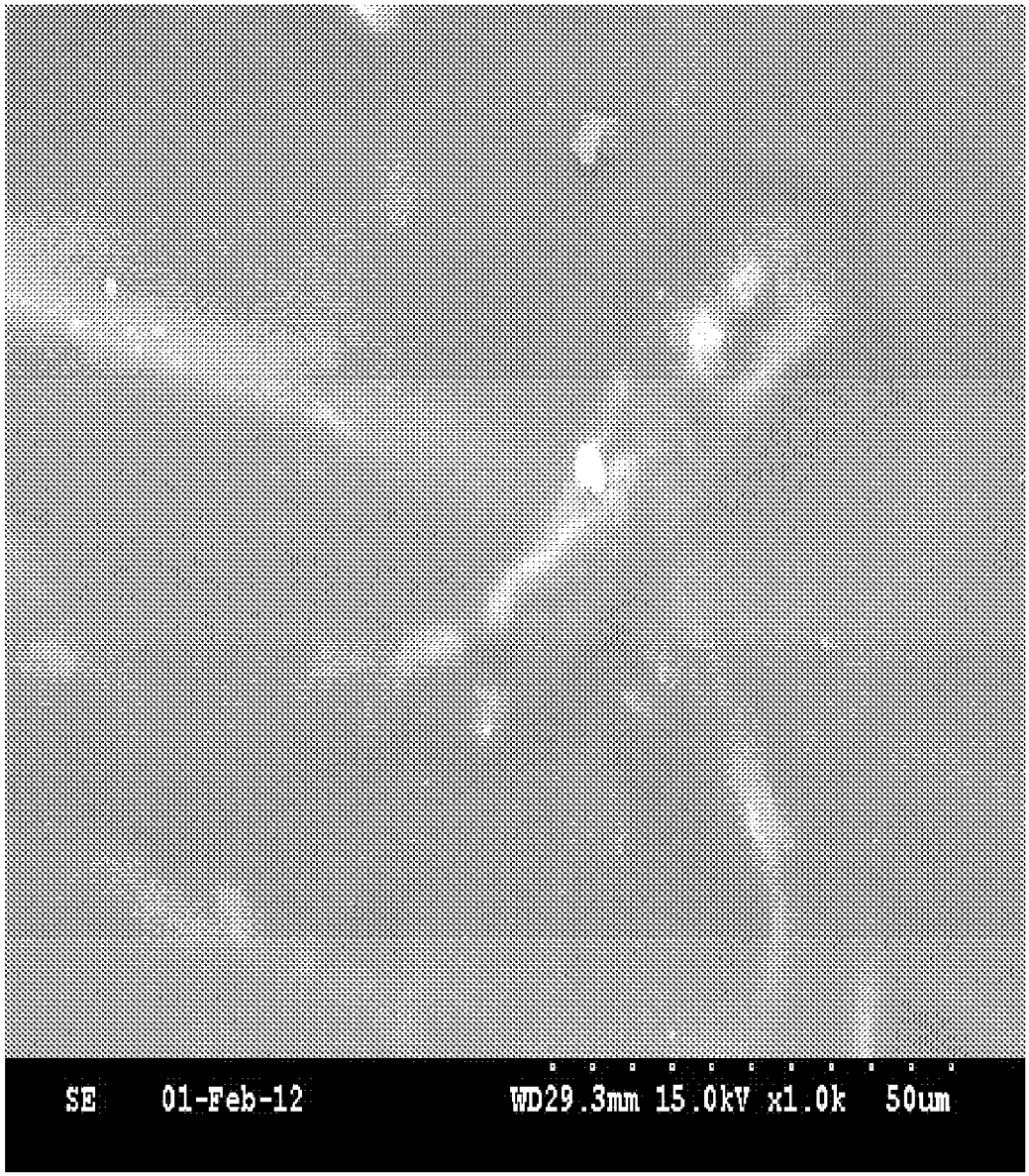
Figure 28:
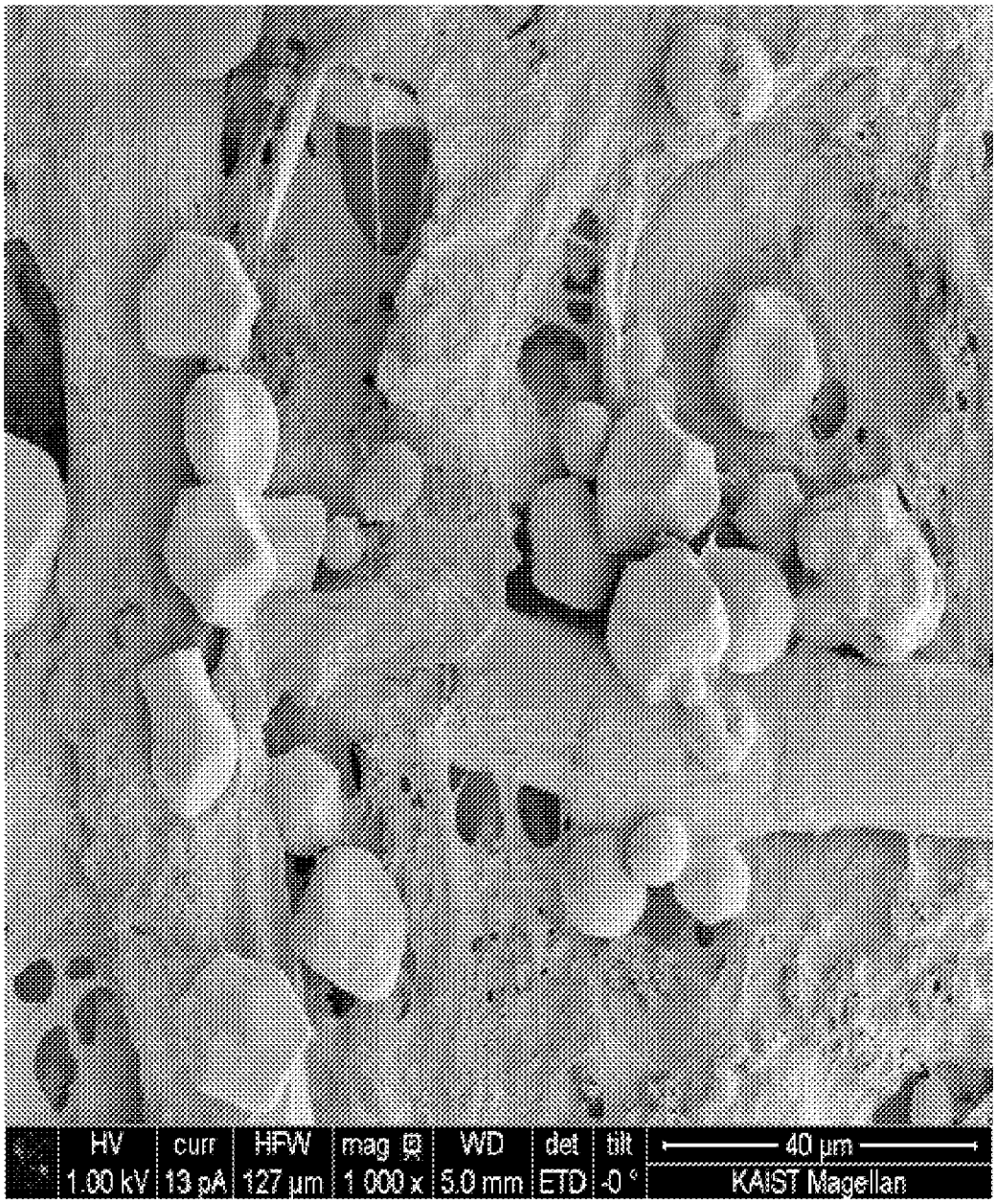
FIGS. 28 to 31 are SEM photographs of the cigarette papers when the 10 wt % hydrophilic starch is mixed with 10 wt %, 15 wt %, 20 wt %, and 25 wt % of hydrophobic starch, respectively.
Figure 29:
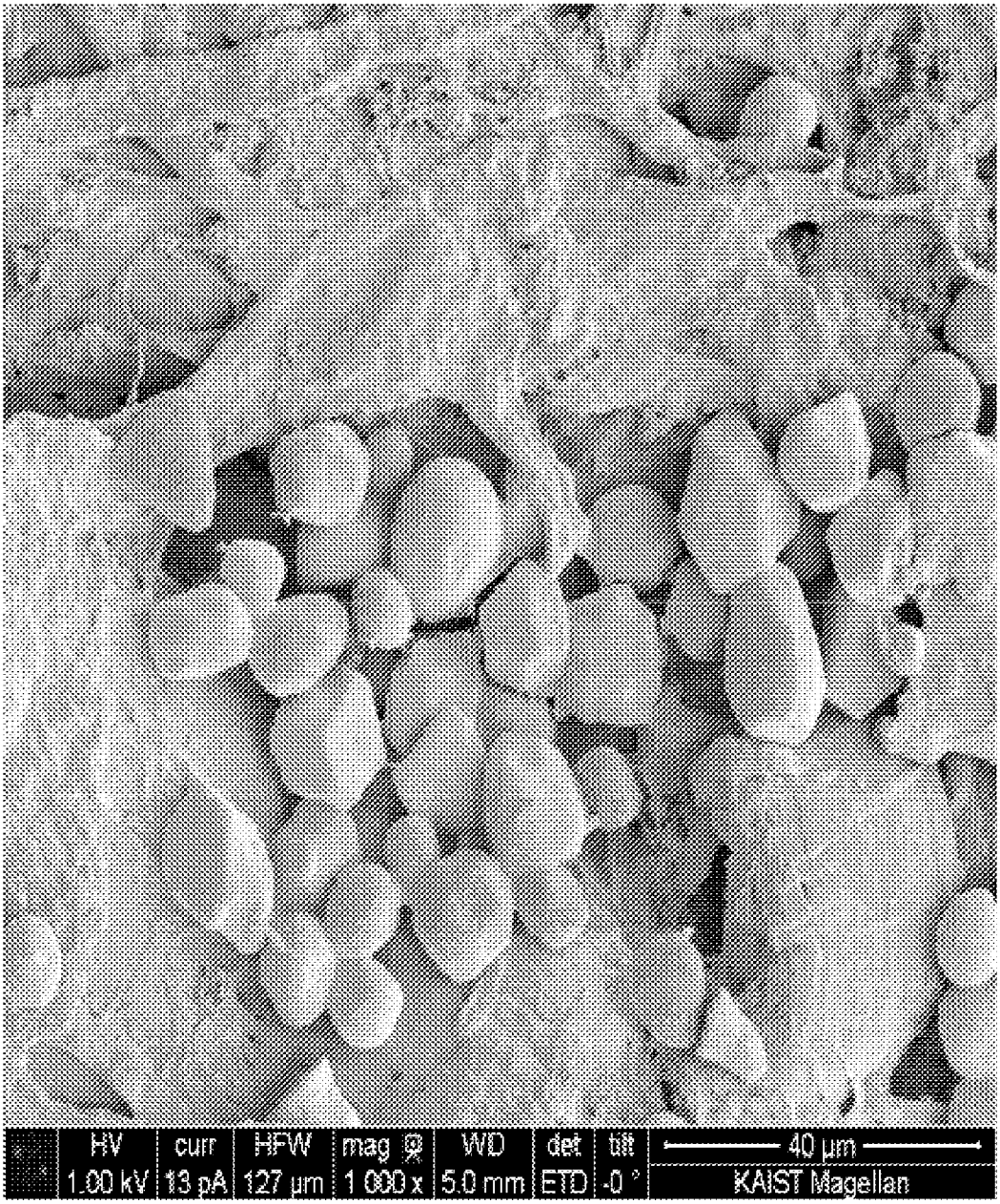
Figure 30:
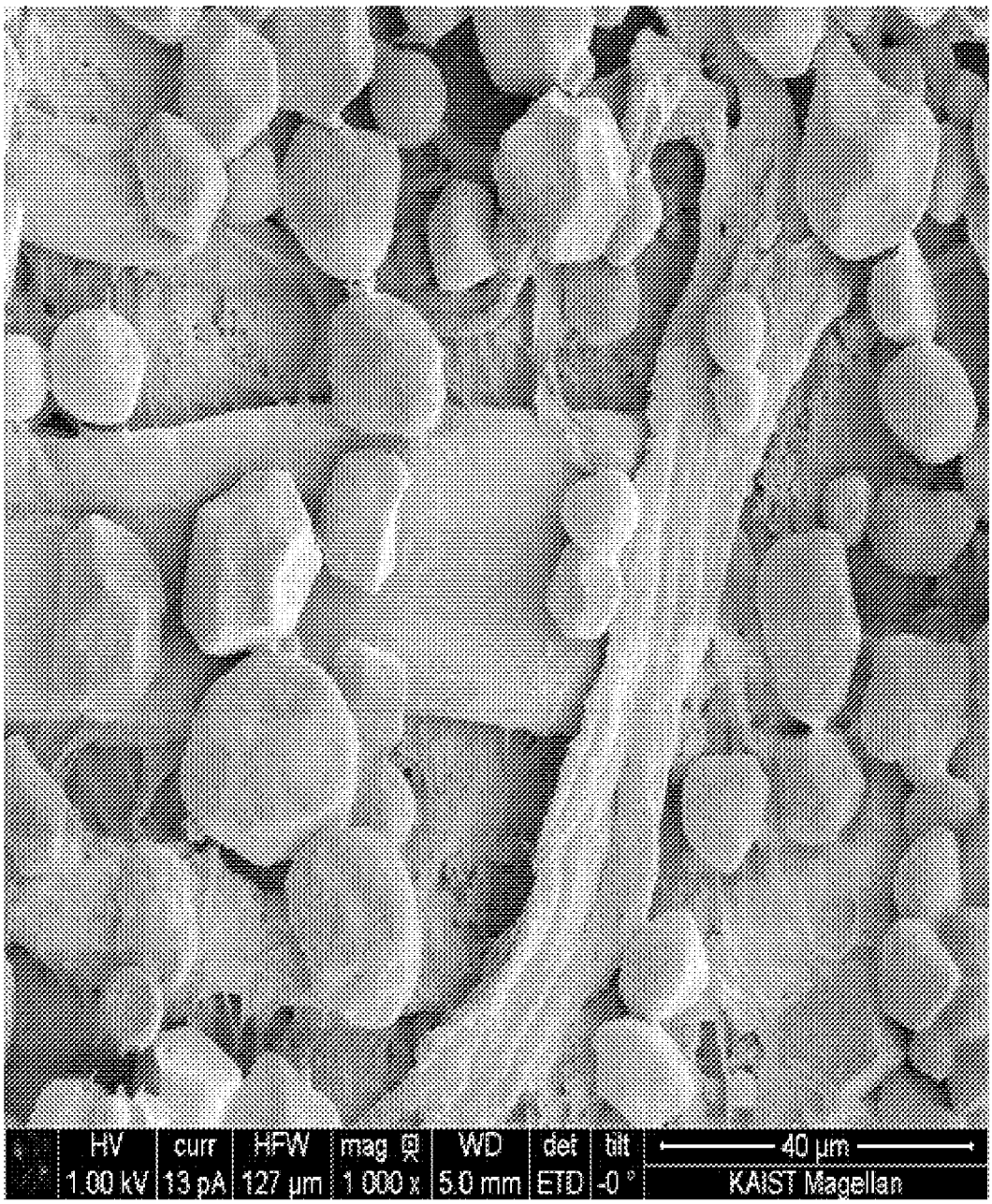
Figure 31:
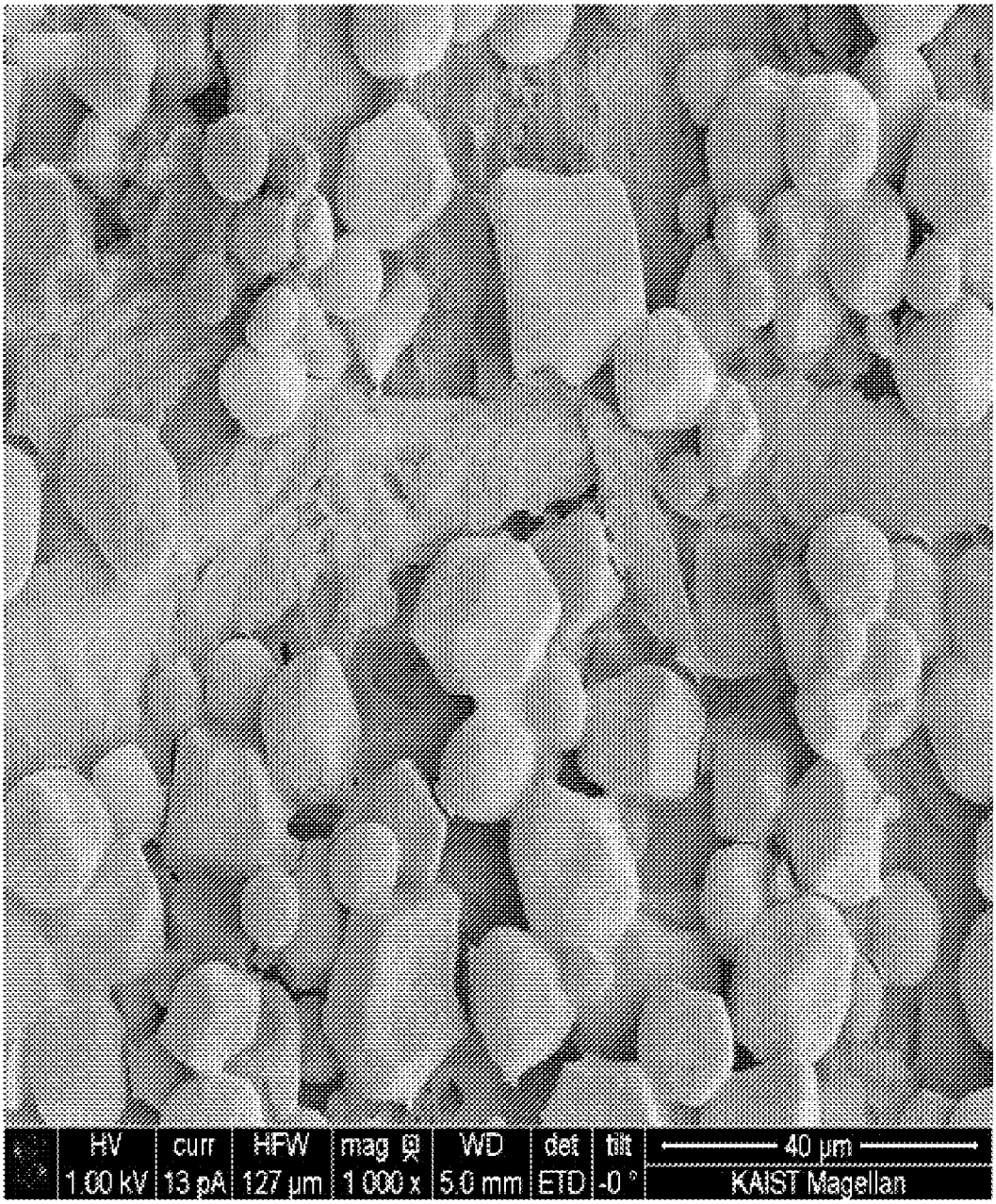
Figure 32:
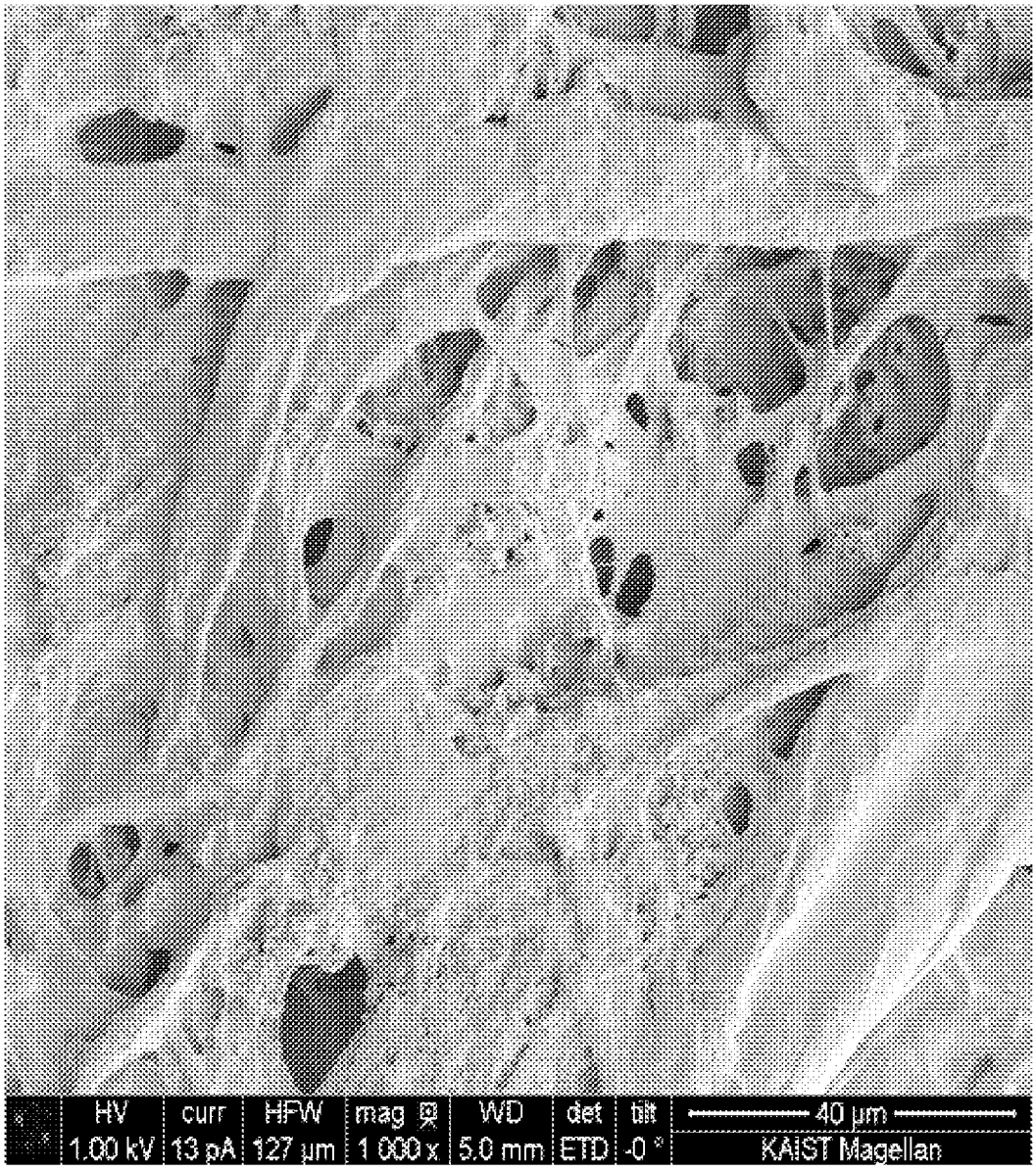
FIGS. 32 to 35 are SEM photographs of the cigarette papers when 20 wt % hydrophilic starch is mixed with 0 wt %, 5 wt %, 10 wt %, and 15 wt % of hydrophobic starch, respectively.
Figure 33:
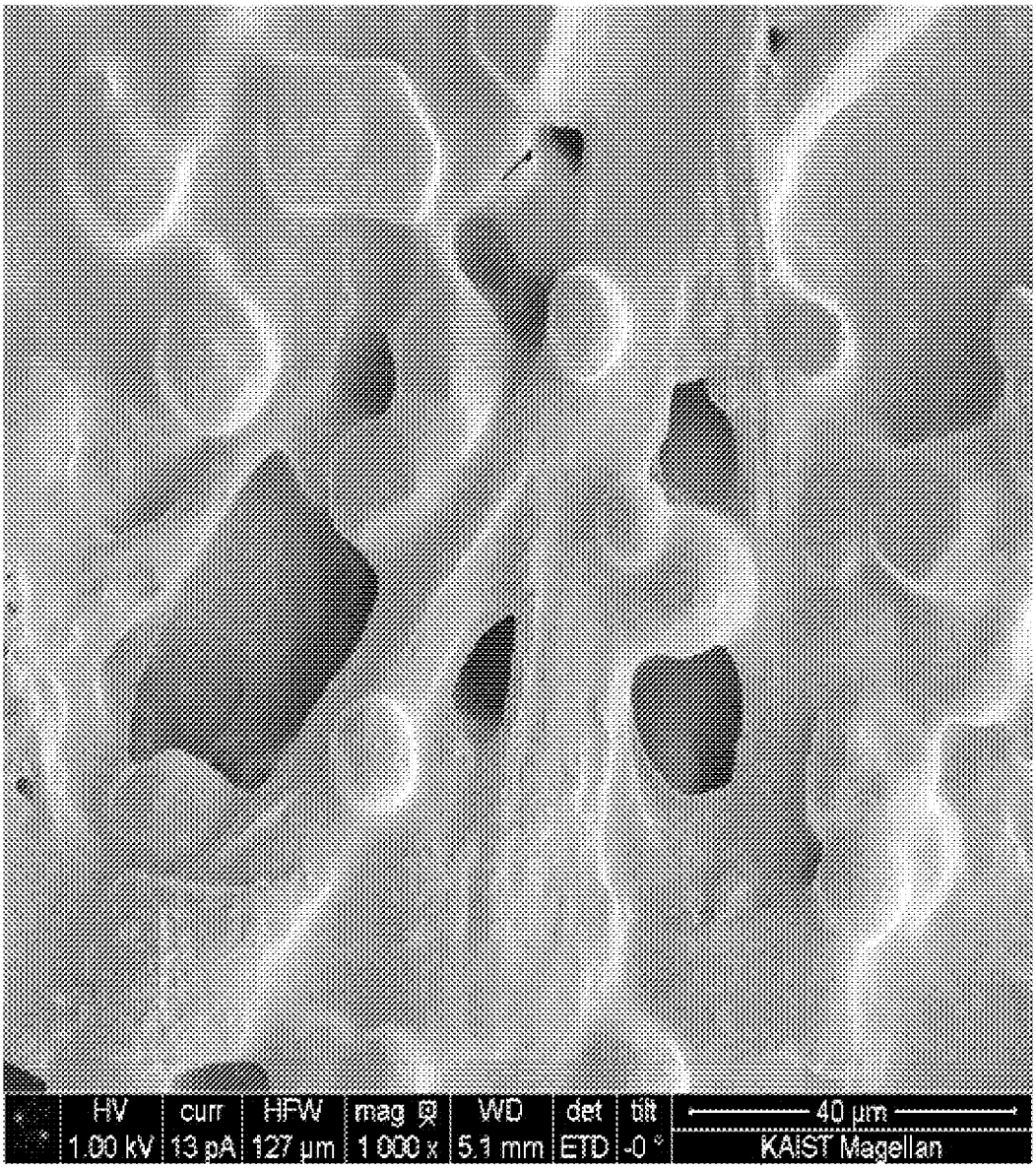
Figure 34:
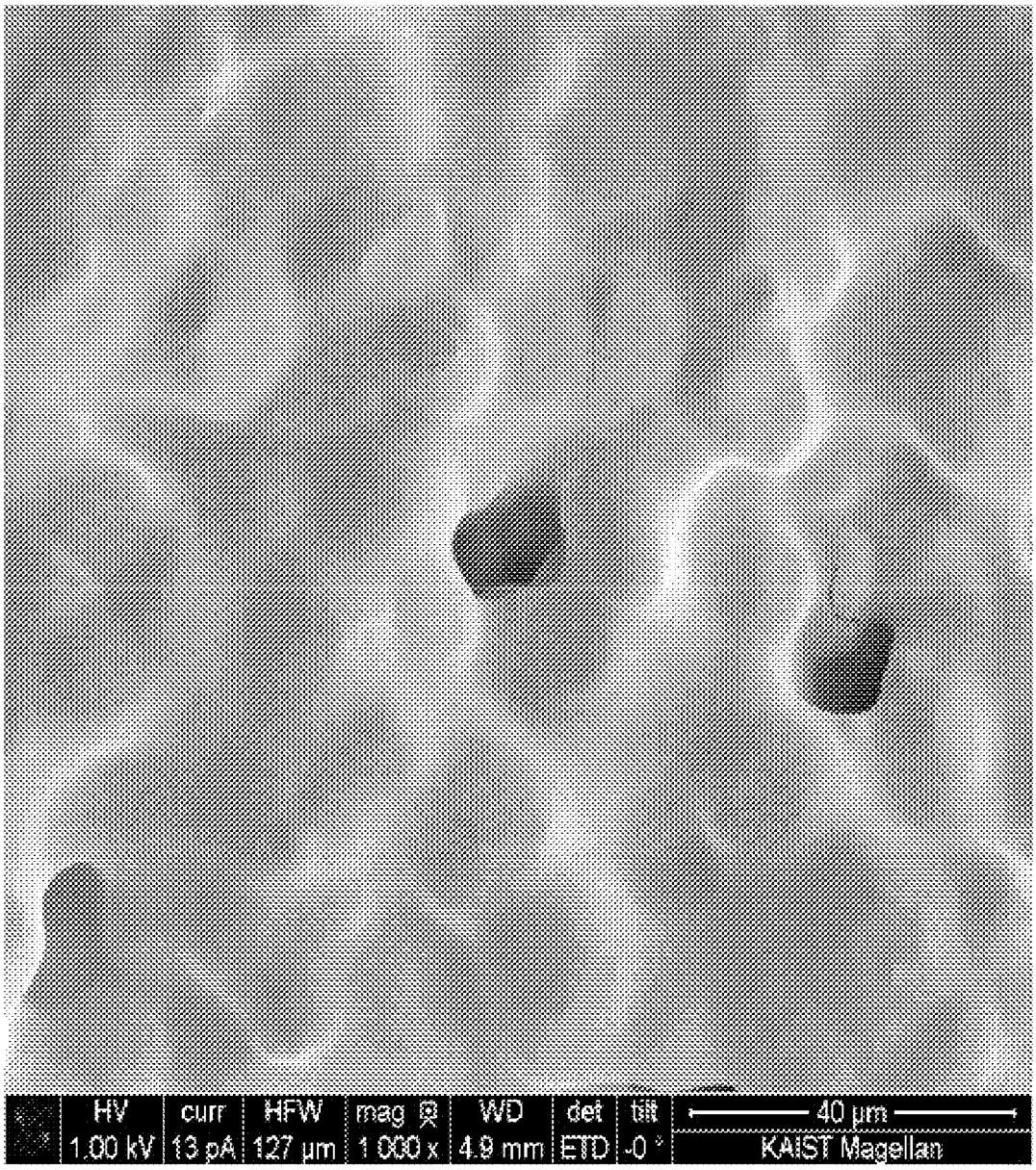
Figure 35:
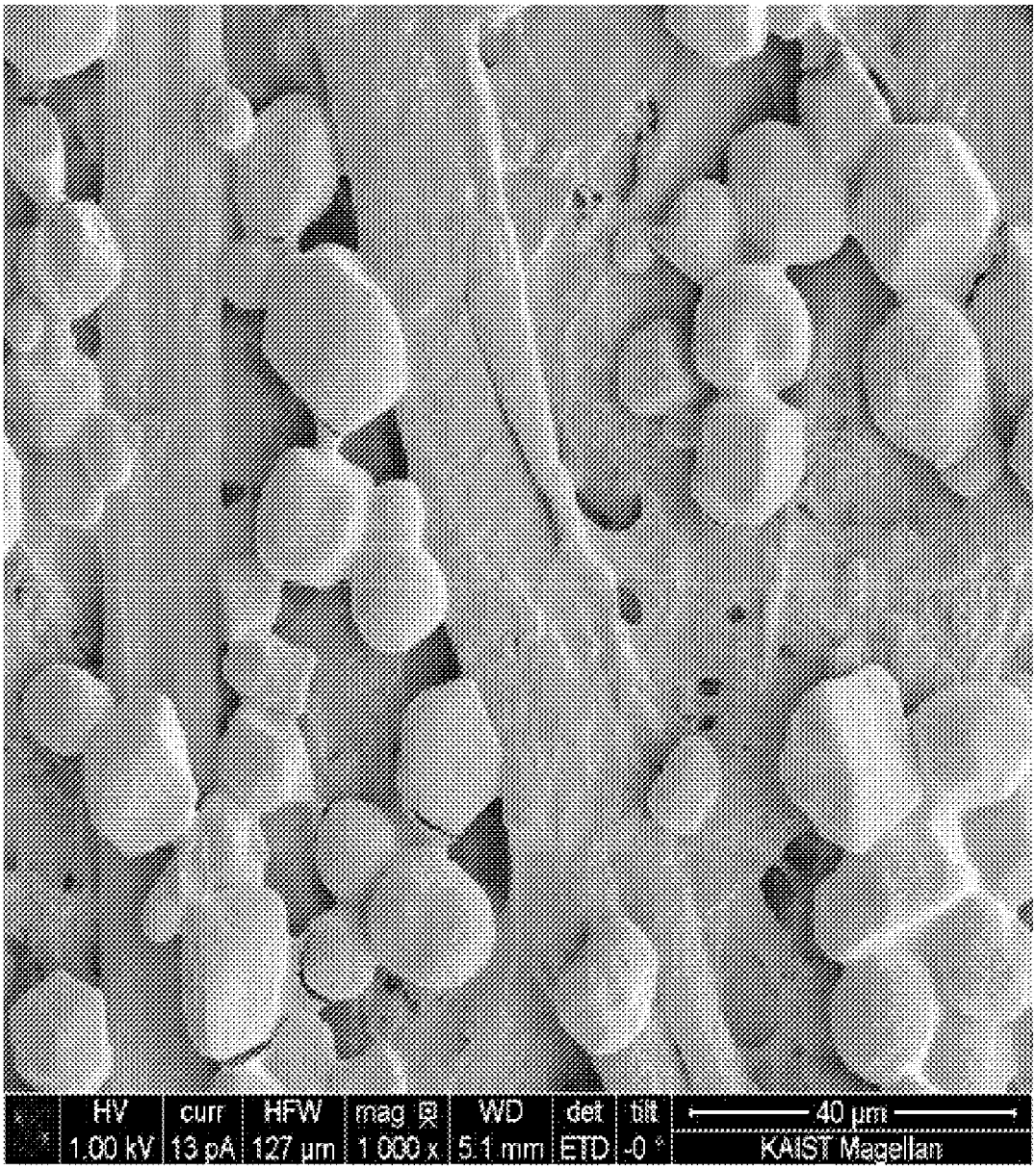

FIG. 18 and FIG. 19 are graphs showing porosity changes according to contents of starch. When the hydrophobic starch is solely used in the coating composition, it may not be easy to control porosity of the cigarette paper. The coating composition in which the hydrophilic starch is solely used may control porosity of the cigarette paper more easily than coating compositions in which about 10 wt % hydrophilic starch is mixed with the hydrophobic starch. However, considering the tensile strength, the coating composition in which about 20 wt % hydrophobic starch and about 10 wt % hydrophilic starch are mixed with each other may control porosity of the cigarette paper most easily.

Morphology

FIGS. 20 to 23 are SEM photographs of the cigarette papers when 20 wt %, 25 wt %, 30 wt %, and 35 wt % of hydrophobic starch is solely used, respectively. Referring FIGS. 20 to 23, when the hydrophobic starch is solely used in the composition, the considerable amount of the hydrophobic starch is not adsorbed in the cigarette paper but stacked on the cigarette paper. In addition, as contents of the hydrophobic starch increase, the amount of the hydrophobic starch which is not adsorbed in the cigarette paper increase, and particles of the hydrophobic starch show a phase difference and light and shade.

FIGS. 24 to 27 are SEM photographs of the cigarette papers when 20 wt %, 25 wt %, 30 wt %, and 35 wt % of hydrophilic starch is solely used, respectively. Referring FIGS. 24 to 27, about 20 wt % and about 25 wt % of hydrophilic starch may not control pores of the cigarette paper. About 30 wt % and about 35 wt % of hydrophilic starch may control pores but show a phase difference.

FIGS. 28 to 31 are SEM photographs of the cigarette papers when about 10 wt % hydrophilic starch is mixed with about 10 wt %, 15 wt %, 20 wt %, and 25 wt % of hydrophobic starch, respectively. Referring FIGS. 28 to 31, when about 10 wt % hydrophilic starch is used, micrometer-size pores of the cigarette paper may be controlled enough, but nanometer-size pores of the cigarette paper may not be controlled enough.

FIGS. 32 to 35 are SEM photographs of the cigarette papers when about 20 wt % hydrophilic starch is mixed with about 0 wt %, 5 wt %, 10 wt %, and 15 wt % of hydrophobic starch, respectively. Referring FIGS. 32 to 35, when the hydrophilic starch is solely used, micrometer-size pores may not be controlled. When about 5 wt % hydrophobic starch is used, part of micrometer-size pores may not be controlled. When about 10 wt % hydrophobic starch is used, nanometer-size pores and micrometer-size pores may be controlled very well. When about 15 wt % hydrophobic starch is used, contents of the hydrophobic starch may be too much because particles of the hydrophobic starch are stacked to the surface of the cigarette paper.

Figure 36:
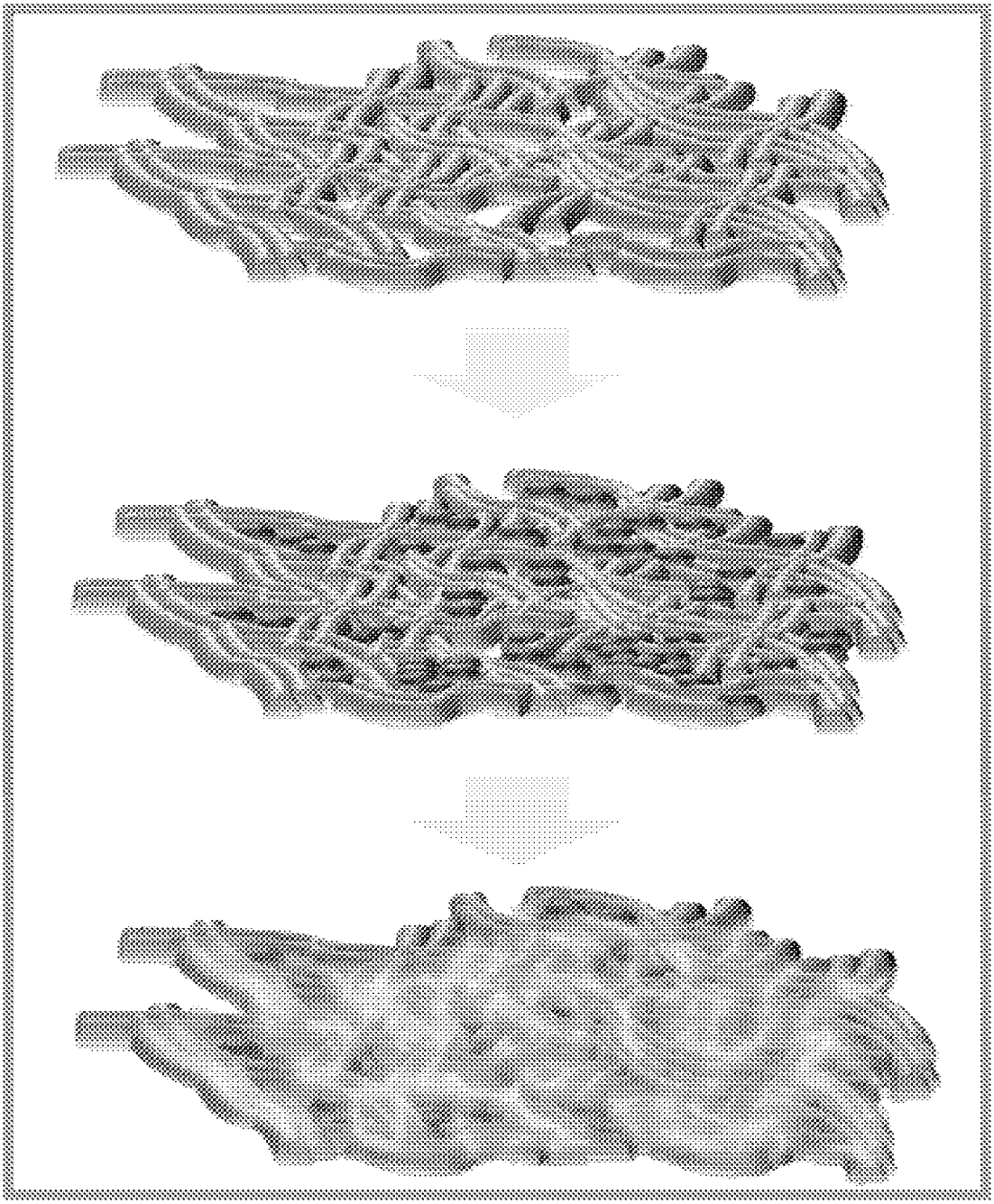
FIG. 36 is a schematic diagram showing the hydrophobic starch and the hydrophilic starch coated on the cigarette paper.

FIG. 36 is a schematic diagram showing the hydrophobic starch and the hydrophilic starch coated on the cigarette paper. As illustrated in FIG. 36, first, cellulosic fibers of the cigarette paper are prepared, and second, hydrophobic starch particles may cover micrometer-size pores in the cellulosic fibers, and third, hydrophilic starch particles may cover nanometer-size pores and the like in the cellulosic fibers.

Figure 37:
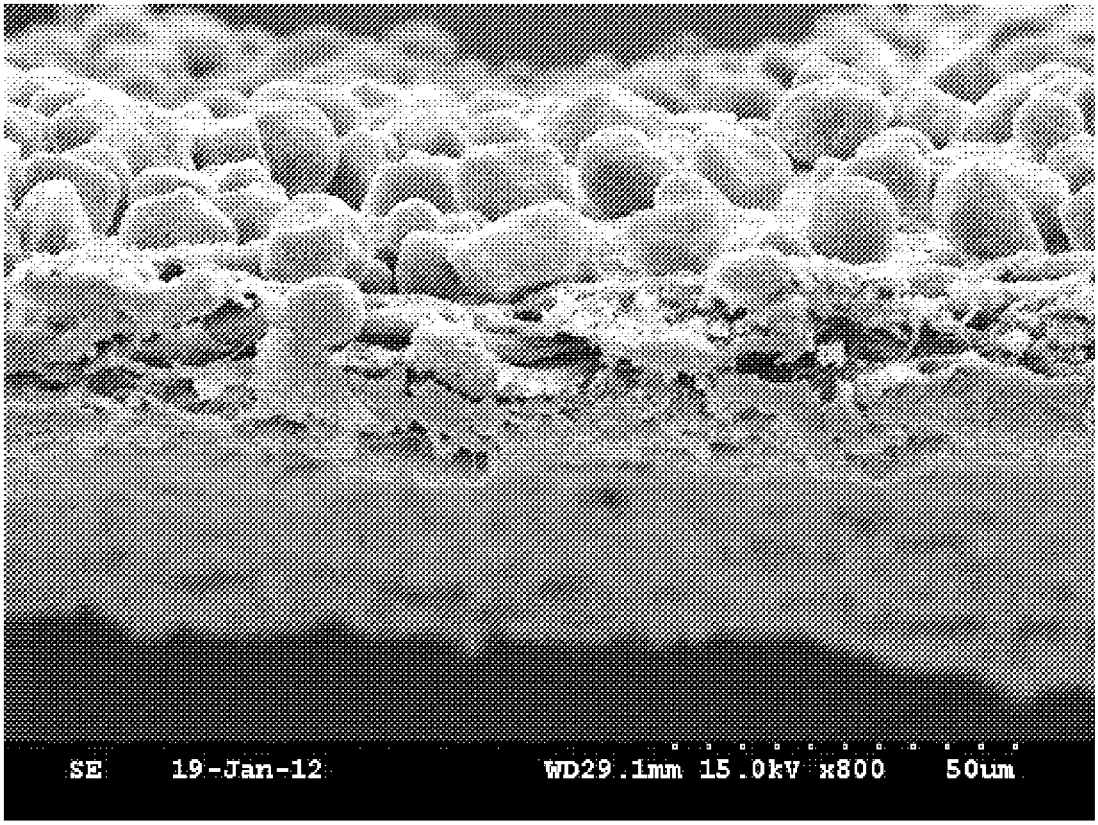
FIGS. 37 to 39 are SEM photographs of cross-sections of the cigarette papers coated with the coating composition.
Figure 38:
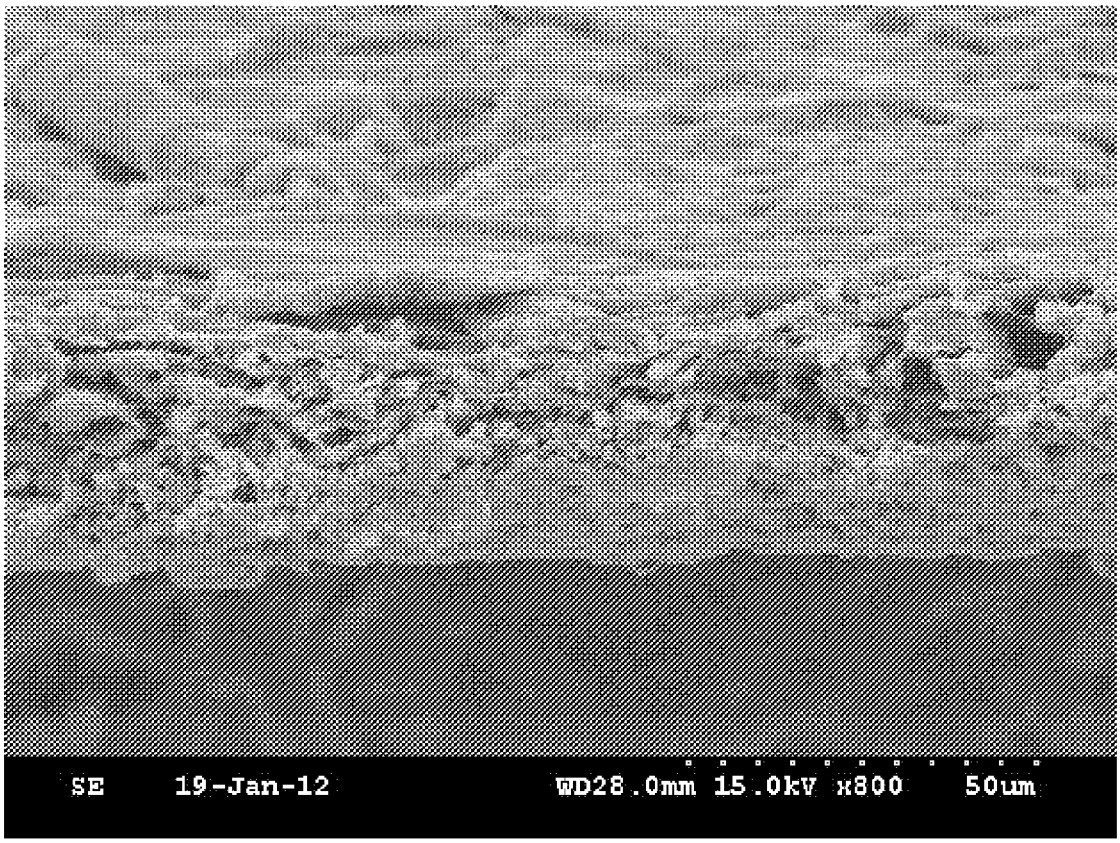
Figure 39:
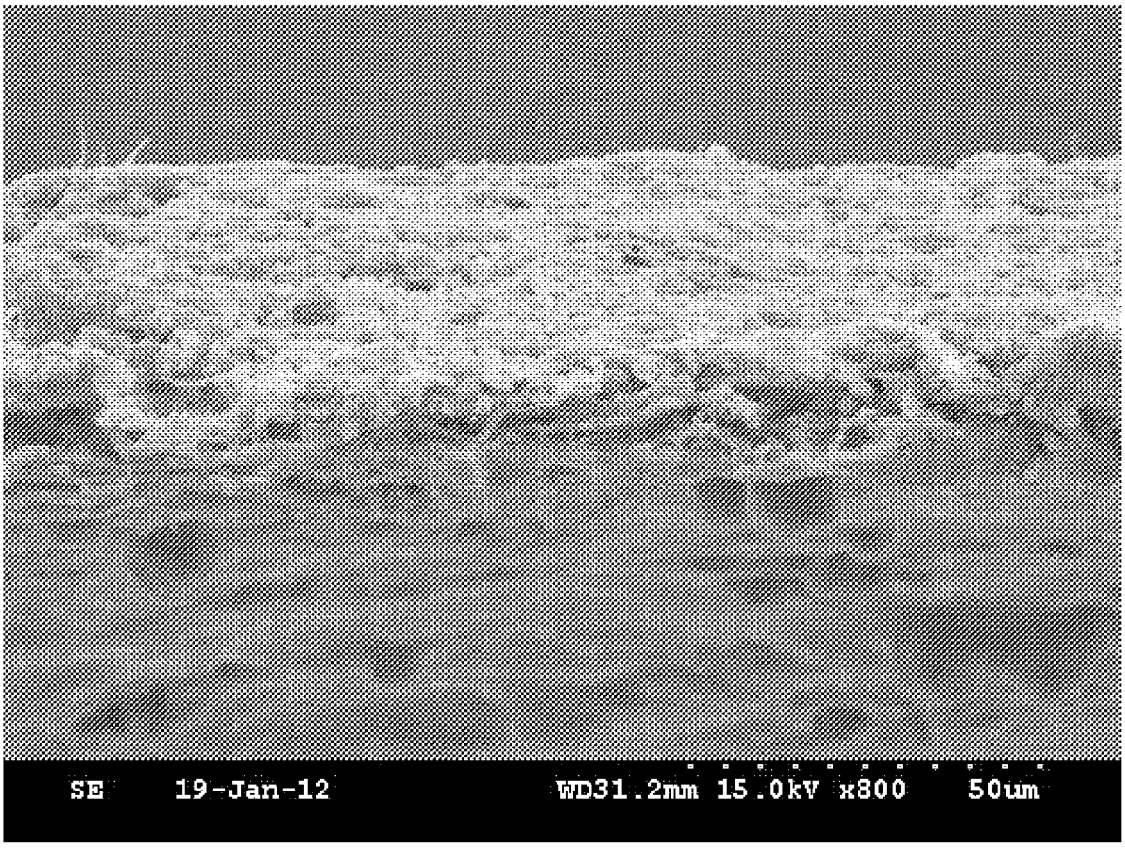

FIGS. 37 to 39 are SEM photographs of cross-sections of the cigarette papers coated with the coating composition. FIG. 37 shows a cross-section of the cigarette paper when the hydrophobic starch is solely used, FIG. 38 shows a cross-section of the cigarette paper when the hydrophilic starch is solely used, and FIG. 39 shows a cross-section of the cigarette paper when the hydrophobic starch and the hydrophilic starch are mixed with each other. Referring FIGS. 37 to 39, when the hydrophobic starch is solely used, particles of the hydrophobic starch are stacked on cellulosic fibers similar to FIG. 36. When the hydrophilic starch is solely used, part of hydrophilic starch shows a fluidic characteristic. When the hydrophobic starch and the hydrophilic starch are mixed with each other, particles of the hydrophobic starch are disposed between cellulosic fibers and the hydrophilic starch fills remaining spaces, so that a coating surface may be the most flat among three of them.

Dryness

In order to analyze water dry weights, weight changes of the specimen are measured in real time after coating materials are coated on the specimen.

Figure 40:
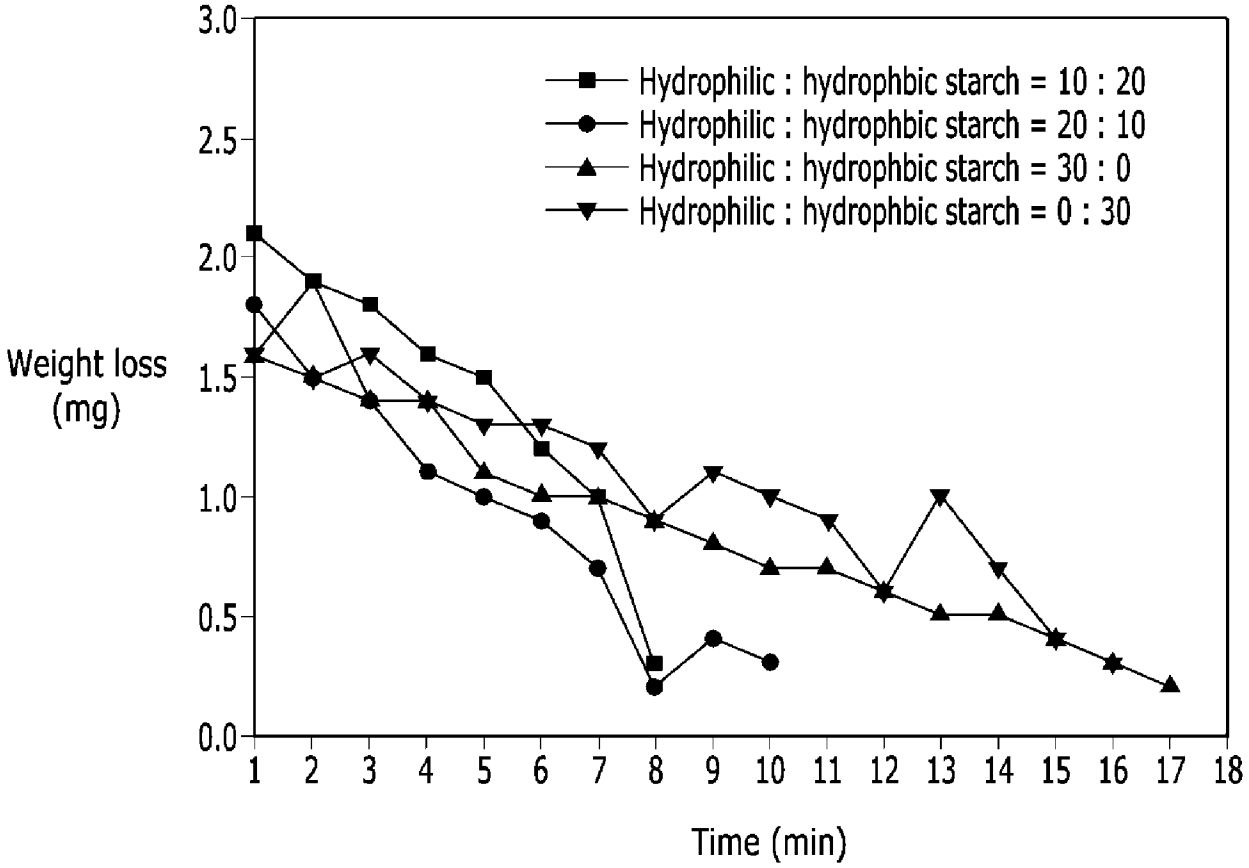
FIG. 40 is a graph of water dry weight changes according to contents of starch.

FIG. 40 is a graph of water dry weight changes according to contents of starch. Referring FIG. 40, a specimen mixed the hydrophobic starch with the hydrophilic starch may have dryness better than a specimen used alone the hydrophobic starch or the hydrophilic starch. Further, a specimen mixed about 10 wt % hydrophobic starch with about 20 wt % hydrophilic starch may have dryness better than a specimen mixed about 20 wt % hydrophobic starch with about 10 wt % hydrophilic starch.

While this invention has been described in connection with what is presently considered to be practical exemplary embodiments, it is to be understood that the invention is not limited to the disclosed embodiments, but on the contrary, is intended to cover various modifications and equivalent arrangements included within the spirit and scope of the appended claims.

The invention claimed is:

1. A low ignition propensity cigarette paper comprising:

a coating portion including a hydrophobic starch and a hydrophilic starch, and a plurality of pores including a micrometer-size pore and a nanometer-size pore, wherein the hydrophobic starch and the hydrophilic starch cover the micrometer-size pore and the nanometer-size pore, and wherein a mixing ratio of the hydrophilic starch and the hydrophobic starch is about 18 wt % to about 22 wt %: about 8 wt % to about 12 wt %.

2. The low ignition propensity cigarette paper of claim 1, wherein:

the hydrophobic starch includes a metallic salt.

3. A cigarette, comprising:

a cigarette column portion, and a low ignition propensity cigarette paper surrounding the cigarette column portion and including a coating portion and a plurality of pores, wherein the coating portion includes a hydrophobic starch and a hydrophilic starch, the plurality of pores includes a micrometer-size pore and a nanometer-size pore, and the hydrophobic starch and the hydrophilic starch cover the micrometer-size pore and the nanometer-size pore, and wherein a mixing ratio of the hydrophilic starch and the hydrophobic starch is about 18 wt % to about 22 wt %:about 8 wt % to about 12 wt %.

4. The cigarette of claim 3, wherein:

the hydrophobic starch includes a metallic salt.

5. The cigarette of claim 3, further comprising:

a cigarette filter portion.

6. The cigarette of claim 5, wherein:

the cigarette filter portion includes at least one filter member.

7. The cigarette of claim 5, wherein:

the cigarette filter portion includes at least one of an adsorbent or a flavoring agent.

* * * * *